US006672362B1

(12) United States Patent
Mullet et al.

(10) Patent No.: US 6,672,362 B1
(45) Date of Patent: Jan. 6, 2004

(54) UPWARD ACTING SECTIONAL DOOR

(75) Inventors: Willis J. Mullet, Gulf Breeze, FL (US); Gregory M. Rusnak, Milton, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/710,253

(22) Filed: Nov. 10, 2000

(51) Int. Cl.[7] ..... E05D 15/16

(52) U.S. Cl. ..... 160/201; 160/235; 160/232; 16/96 L; 16/225

(58) Field of Search ..... 160/201, 188, 160/229.1, 235, 236, 209, 232; 16/95 R, 96 R, 96 L, 224, 225

(56) References Cited

U.S. PATENT DOCUMENTS

| | | | | |
|---|---|---|---|---|
| 1,621,669 A | | 3/1927 | Johnson | |
| 3,648,755 A | | 3/1972 | Thiele | 160/201 |
| 3,941,180 A | | 3/1976 | Thill | 160/229 |
| 3,980,123 A | | 9/1976 | Vago | 160/201 |
| 4,095,641 A | * | 6/1978 | Olson | |
| 4,122,633 A | | 10/1978 | Holdiman | 492/501 |
| 4,269,253 A | | 5/1981 | Ziegler | 160/201 |
| 4,436,136 A | | 3/1984 | Downey, Jr. | 160/232 |
| 4,472,910 A | * | 9/1984 | Iha | |
| 4,518,026 A | | 5/1985 | Otto et al. | 160/232 |
| 4,532,973 A | | 8/1985 | DeFalco | 160/235 |
| 4,563,381 A | | 1/1986 | Woodland | 428/156 |
| 4,586,552 A | * | 5/1986 | Labelle | |
| 4,630,664 A | | 12/1986 | Magro | 160/232 |
| 4,893,666 A | | 1/1990 | Hormann | 160/229.1 |
| 4,924,932 A | | 5/1990 | Esnault | 160/201 |
| 4,961,895 A | | 10/1990 | Klein | 264/40.6 |
| 4,979,553 A | | 12/1990 | Lowry, III et al. | 160/133 |
| 5,042,556 A | | 8/1991 | Ruiter | 160/201 |
| 5,135,040 A | * | 8/1992 | Ruiter | |
| 5,165,746 A | | 11/1992 | Teigen | 296/24.1 |
| 5,374,118 A | | 12/1994 | Kruck et al. | 312/407 |
| 5,419,386 A | | 5/1995 | Magro et al. | 160/232 |
| 5,445,208 A | | 8/1995 | Shaner et al. | 160/232 |
| 5,522,446 A | | 6/1996 | Mullet et al. | 160/229.1 |
| 5,613,541 A | | 3/1997 | Bradbury | 160/231.2 |
| 5,622,012 A | | 4/1997 | Schijf | 52/71 |
| 5,626,176 A | | 5/1997 | Lewis, Jr. et al. | 160/201 |
| 5,630,459 A | | 5/1997 | Martin | 160/236 |
| 5,709,259 A | | 1/1998 | Lewis et al. | 160/201 |
| 5,782,283 A | | 7/1998 | Kendall | 160/229.1 |
| 5,842,508 A | | 12/1998 | Krupke et al. | 160/235 |
| 6,112,464 A | | 9/2000 | Grisham et al. | 49/199 |
| 6,328,091 B1 | * | 12/2001 | Whitley | |

FOREIGN PATENT DOCUMENTS

| | | | |
|---|---|---|---|
| DE | 298 13 304 U | 12/1999 | E05F/1/00 |
| EP | 0 291 171 A | 11/1988 | B60J/5/12 |
| WO | WO 90 14486 A | 11/1990 | E05D/15/24 |
| WO | WO 96 21078 A | 7/1996 | E05D/15/26 |
| WO | WO9702401 | 1/1997 | E06B/3/48 |

* cited by examiner

*Primary Examiner*—Blair M. Johnson
(74) *Attorney, Agent, or Firm*—Renner, Kenner, Greive, Bobak, Taylor & Weber

(57) ABSTRACT

An upwardly acting sectional door (24), including a plurality of panels (40), body portions (50) of the panels constructed of a flexible polymeric material and having a front surface (55), a cladding (80) covering the front surface of the body portions and having hooks (83, 84) at the upper and lower edges thereof, a hinge member (51) at an edge of the body portion operatively engaging the hooks of adjacent of the panels to provide relative pivotal motion between adjacent panels. Another embodiment is an upwardly acting sectional pan door (224) including, a plurality of panels (240), facers (250) of the panels defining a front surface of the door and having cooperatively engaging couplers (270) at the upper and lower edges thereof, stiles (280) at the ends of the facers receiving and attached to the facers, and hinge assemblies (290) located at the end stiles to provide relative pivotal motion between the stiles and the couplers of adjacent panels.

30 Claims, 24 Drawing Sheets

UPWARD ACTING SECTIONAL DOOR

TECHNICAL FIELD

The present invention relates to upward acting sectional doors. More particularly, the present invention relates to an upward acting sectional door having a flexibly hinged plastic core with metal cladding or a pan door with or without insulation. More particularly, the present invention relates to an upward acting sectional door having integral hinges that allow the door to pass through a very short transitional radius, a metal cladded exterior surface, interior insulation, if desired, and the capability of being packaged substantially preassembled, complete with a counterbalance system and operator installed.

BACKGROUND ART

There are numerous doors that are vertically oriented in the closed position and store in an open overhead position that are used as doors for buildings and trailers.

One common construction is a tilting, non-flexible one-piece door. This type of door may be of generally two constructions. The first is a center pivoting door that uses a framework to which the door is mounted that pivots on a horizontal axis proximate to the vertical center of the door. These doors require space immediately adjacent to the door on the inside and outside for the door to open and close. The action of the door makes entrapment possible at the sides and bottom of the door. The second type of one-piece door uses horizontal and vertical tracks to guide the door between open and closed positions. These doors do not require clearance space adjacent to the outside of the door but require a considerable amount of clearance space to the inside of the door to allow the door to open and close. These doors present the same potential entrapment dangers as the pivoting door. These types of doors have been used on buildings but are not suitable as trailer doors in that the inside clearance space needed to open and close the door would significantly decrease the payload of the trailer. Further, if the cargo shifted during transit, the door could be jammed in the closed position.

Another common type of door is a sheet door. Sheet doors have flexible door panels that are guided around rotatable guide wheels between the open and closed positions. When in the open position, the flexible door panel is substantially horizontal to maximize the height clearance in the doorway opening. These doors are made from a flexible plate material that requires reinforcement at the edges. The flexible plate material must be formed into a pivot strengthening profile to give the door adequate strength and must use a rather large drive wheel to move the flexible plates from the horizontal to vertical tracks and from the vertical to horizontal tracks as the door is opened or closed. While increasing headroom or decreasing the hang down of the door into the door opening, these doors are somewhat flimsy and noisy to operate. Moreover, the inability to move the plates through a conventional transitional radius necessitates the use of large diameter drive rollers on either side of the door consuming significant interior space. The bending of the plates around the drive rollers causes undesirable stress on the plates and precludes tolerance to above-normal wind pressure.

Sectional doors are well known in the art. One concern with sectional doors, however, is the entrapment of hands or fingers at the interfaces of the door sections and along the edges of the door. Pinch-resistant sectional doors have been developed with integrally formed section interfaces that eliminate the finger and hand entrapping gaps, but these doors still require additional hardware to perform this function. Similar hardware may be added to a conventional sectional door to perform the same function. To prevent entrapment at the edges of the door, longitudinal mating sections have been added to pinch resistant sectional doors and conventional sectional doors.

As a further disadvantage, sectional doors generally have hinges and other hardware mounted on the interior of the door. If used as a trailer door, this hardware may damage cargo within the trailer or interfere with door movement. Attempts have been made to remove this disadvantage by designing doors with continuous hinges. Generally, these hinges are constructed of polymeric material and may be an integral component of the door or installed as a separate component between the sections. Although these hinge designs can be flush with the back of the door, the pivot point established by the hinge is fixed, thereby creating stresses in the hinge and the hinge attachment areas.

Rolling doors made from a plurality of slats or a sheet of metal suffer a similar buildup of stresses in the hinge because they also have a fixed pivot point. Rolling doors, however, have the advantage of pinch resistance because they are made of a plurality of closely fitting slats. But, due to the shorter height of the slats, a large number of slats are necessary to cover the door opening resulting in the rolling door being heavier and more expensive than sectional doors. These doors also require extensive headroom to store the rolled up door when the door is in the open position. The large number of slats also increases the time necessary to manufacture and assemble these doors. Assembly is complicated by the fact that these doors require the slats to be individually longitudinally interlaced. This interlacing also results in an interconnection which transmits force between slats so that even a localized impact can result in damage to a number of adjacent panels. While the slats are often constructed of sheet steel offering little insulation, additional plastic insulated materials and insulation covers have been added to these types of doors. As will be appreciated, the addition of plastic insulating material increases the weight and complexity of the door, thereby increasing the cost to the manufacturer and the time necessary to manufacture the door. Further, these rolling door designs normally have fixed pivot points with no provision for reducing stresses in the area of the hinges.

Some sectional doors have utilized polymeric materials for door components, including the door sections. In one instance, a door has been constructed of blow-molded polymeric material sections for use on building structures such as industrial, commercial, and residential garages. In another instance door panels having a polyurethane rigid core with a polyvinylchloride front skin and a non-metallic rear skin have been proposed. The rigid polyurethane core unitizes the two skins to make the panel section into a rigid lightweight structure. These known designs require expensive equipment of considerable size, particularly to process a double car width door section. Further, these doors contain conventional hardware such as stiles and hinges, which protrude into the area adjacent the interior surface of the door. Overall, the main difference between a conventional sectional door and these doors is the use of polymeric sections.

Sectional doors with sections from 18–24 inches in height necessarily have a relative angular movement between sections of up to 78° when traversing the transitional radius between the open and closed positions. These angular movements of the sections alter the force required to move the door and put stress on the hinge and hinge mounting area. It has been recognized that hinges with multiple bend points may reduce the stress on hinge elements as well as hinges having a plurality of co-extruded polymers to achieve a hinge capable of continuous movements of up to 90° or more. The extruded thermoplastic hinge has improved ability to withstand flexure cycles at room temperature as well as low temperatures. This hinge comprises a flexible cross-section of polyester elastomer and a co-extruded section of rigid or semi-rigid thermoplastic material. This type of hinge design is more costly and care must be taken during the extrusion process to assure adequate bonding or encapsulation of the different polymers used to produce the hinge.

DISCLOSURE OF THE INVENTION

Therefore, an object of the present invention is to provide an upward acting sectional door in which the body of the door is an extruded corrugated polymer which provides an extent of insulation, without foamed insulating material and backing, as well as noise reduction for a quieter operating door than conventional sheet metal doors. Another object of the invention is to provide such a sectional door wherein the corrugated polymer has relatively high strength, is light weight, is low maintenance in not requiring painting, allows for expansion and contraction without warping the door, and can be produced at relatively low cost. A further object of the invention is to provide such a sectional door wherein the door has minimal intrusion interiorly of the door opening and may have a smooth interior surface which tends to avoid catching on objects in proximity to the interior surface which could cause damage to the object or the door. Yet another object of the invention is to provide such a sectional door wherein the polymer provides a movable pivot hinge function between the door sections.

Another object of the present invention is to provide such a sectional door having a body of corrugated polymer which can be coupled with an exterior metal cladding and/or tubular steel inserts to develop sufficient strength and rigidity for a particular door size and specifications. Yet a further object of the invention is to provide such a sectional door wherein end stiles, exterior metal cladding, and tubular steel inserts slide or snap into position to thereby eliminate the extensive use of fasteners or adhesives to interconnect the components of the door. Still another object of the invention is to provide such a sectional door which can be employed with conventional track configurations for sectional doors, but may mount the engaging rollers at substantially the centroid of the corrugated polymer body, whereby with the movable pivot hinge construction the door can negotiate a curved transitional track section between horizontal and vertical track section of approximately one half the normal radius.

Yet another object of the present invention is to provide such a sectional door which incorporates pinch resistant features at the juncture between the sections of the door. Another object of the invention is to provide such a sectional door which does not have projecting hardware at the ends of the door so that finger protection elements may be provided between the door edges and the vertical tracks. Still a further object of the invention is to provide such a sectional door that can employ known counterbalance systems and operators and will accommodate conventional lock systems and windows. Another object of the present invention is to provide such a sectional door which is of sufficiently light weight to be shipped completely assembled with the counterbalance system tensioned and with a motorized operator installed, if desired.

The present invention further provides a vertically operated door including a plurality of door sections rotatably attached to each other, each section having a front surface and a rear surface spaced from each other by an internal structure, the internal structure defining a plurality of encapsulated spaces between the front and rear surfaces which provide a thermal break therebetween.

A sectional door having a plurality of panels joined by a hinge, the hinge having a flexible member extending between adjacent sections; the member defining a first axis and a second axis about which the sections pivot, wherein the axes are moveable during operation of the door such that stresses within the hinge caused by the rotation of the sections are relieved by movement of and about the axes.

A sectional door having a pair of opposed tracks for guiding the door between a closed position and an open position, the tracks having an inner surface, an insert received within the tracks with a polymeric member having a first portion that defines the inner surface of the track and a second portion extending axially from the first portion to at least partially cover the door to effect finger protection.

A door selectively moveable between an open position and a closed position relative to an opening including, a plurality of elongate corrugated horizontal panels pivotally connected at top and bottom edges of adjacent panels by a hinge member defining a first axis and a second axis wherein the first axis and second axis are moveable relative to each other such that stresses within the hinge member created by the pivotal movement of adjacent panels are relieved by the movement of the hinge member about the first and second axes.

A cladding member, in a door system, a cladding member including a generally planar body having a top edge and a bottom edge; a first hook extending from the top edge; and a second hook extending from the bottom edge, the hooks adapted to attach the cladding members to the door.

An end stile in a door system having an open ended channel member adapted to engage the ends of the door sections, the channel members on adjacent sections being in pivotal relationship to each other, each member having a front facer and a rear facer spaced from the front facer by an end extending therebetween, whereby the stiles cover the sides of the sections and move with the sections.

A pre-packaged door kit having a pair of spaced jambs spanned by a header; a first pair of tracks adjacent the jambs, a door having a plurality of corrugated polymer panels pivotally joined by a hinge member, the door being received in the tracks; a counterbalance system and operator attached to the header and operatively engaging the door; a second pair of tracks adapted to be attached to the first and tracks releasably attached to the door; and a back bar adapted to be attached to the second tracks releasably attached adjacent the door.

In a door having a plurality of sections including a top section, the sections being mounted between a pair of tracks which guide the door between a closed and an open position, a pivotal roller attached to the top section by an arm rotatably attached to the top section at one end and a wheel rotatably attached to the arm at the other end, wherein the wheel fits within the tracks causing the arm to pivot from a generally perpendicular position relative to the top section when the door is in the closed position to a generally planar position when the door reaches the open position.

An object of the present invention is to provide as an alternate a sectional pan door system which may be provided with or without insulation. Another object of the invention is to provide such an insulated sectional pan door wherein conventional foam insulation is mechanically retained by door panel components without the necessity for employing adhesives. A further object of the invention is to provide a sectional pan door which has minimal intrusion interiorly of the door opening, which works with a conventional track, and which can traverse a curved transitional track section having a greatly reduced radius without stressing the hinges or hinge areas. Yet another object of the invention is to provide a sectional pan door which is hinged at the end stiles, has pivotal closure assemblies extending the lateral extent of the panels at the edges to provide a pinch-resistant configuration, and may have spaced coupler elements to stabilize the pivot axis of the pivotal closure assemblies.

A further object of the invention is to provide a sectional pan door which does not have projecting hardware at the end stiles so that finger protection elements may be provided between the door edges and the vertical tracks. Another object of the invention is to provide a sectional pan door that can be adapted to a tension-type system for resisting wind loads through the roller assemblies and have a combined roller assembly and counterbalance system cable-securing device at the lower corners of the door. A still further object of the invention is to provide a sectional pan door that is sufficiently lightweight to be shipped completely assembled with a counterbalance system and motorized operator installed and connected, that is relatively inexpensive but strong, and that may be quickly and easily installed.

In general, the alternate embodiment contemplates, an upwardly acting sectional pan door, including a plurality of panels, facers of the panels defining a front surface of the door and having cooperatively engaging couplers at the upper and lower edges thereof, stiles at the ends of the facers receiving and attached to the facers, and hinge assemblies located at the end stiles to provide relative pivotal motion between the stiles and the couplers of adjacent panels.

DETAILED DESCRIPTION

Figure 1:
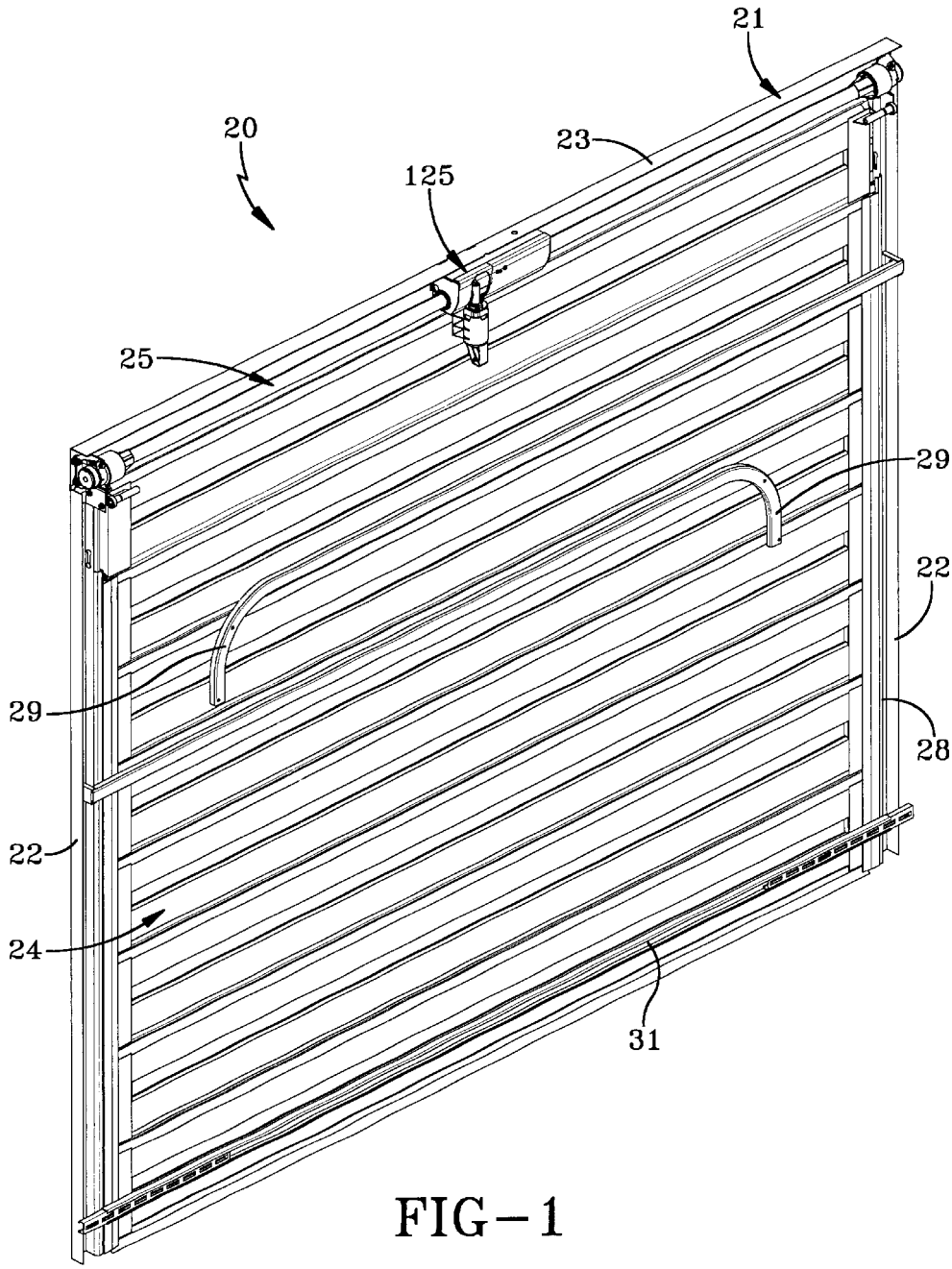
FIG. 1 is a perspective view depicting an upward acting sectional door embodying concepts of the present invention shown packaged for shipment as an assembled unit including the track system, a pre-tensioned counterbalance system, and an operator.
Figure 2:
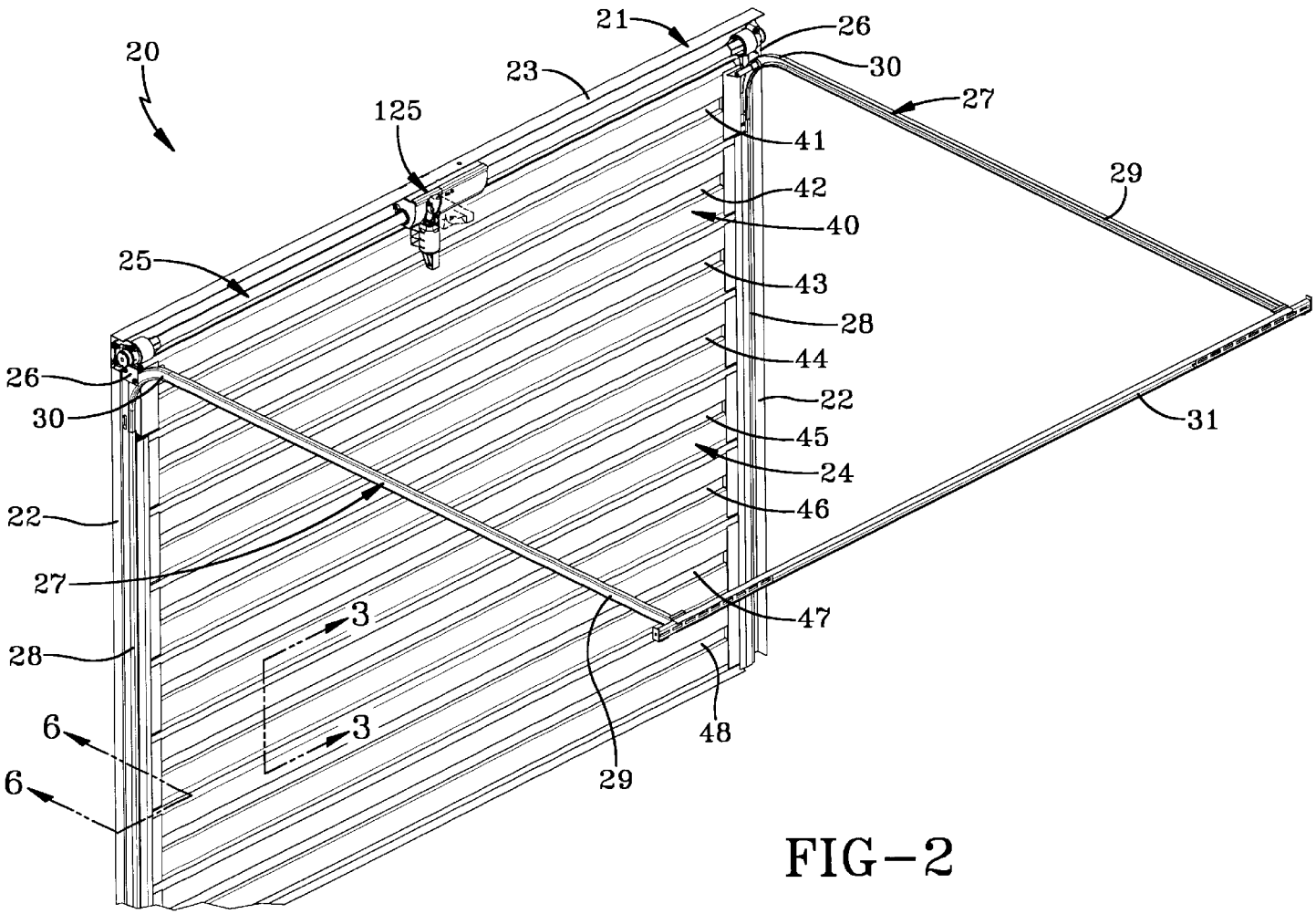
FIG. 2 is a perspective view depicting the door according to FIG. 1 as it might be installed with the horizontal tracks in operative position and braced with a back bar.

An upward acting metal cladded sectional door system embodying concepts of the present invention is generally indicated by the numeral 20 in FIG. 1 of the drawings. The door system 20 is positioned and mounted for opening and closing movement in a building or trailer by a peripheral door frame, generally indicated by the numeral 21. The frame 21 consists of a pair of spaced vertical track framers 22, 22 that, as seen in FIGS. 1 and 2, are generally parallel and extend vertically upwardly relative to a supporting surface such as a floor or the bed of a trailer (not shown). The vertical track framers 22, 22 are spaced and joined proximate their vertical upper extremity by a header framer 23 to thereby define the generally inverted U-shaped frame 21 for mounting a door, generally indicated by the numeral 24. Frame 21 may be constructed of metal or other relatively high strength, rigid material for purposes of reinforcement, attachment to a building or vehicle, and facilitating the attachment of elements involved in supporting and controlling the door 24.

The header framer 23 may advantageously mount a counterbalance system, generally indicated by the numeral 25, that interacts with the door 24 to facilitate raising and lowering of the door 24 in a manner well-known to persons skilled in the art. While a counterbalance system according to applicants' assignee's U.S. Pat. No. 5,419,010 is shown for exemplary purposes and the disclosure therein is incorporated herein by reference, it will be appreciated that any of a variety of different types of counterbalancing systems may be employed, as long as interference with the structure of the door system hereinafter described is, or can be avoided.

Flag angles 26, 26 are provided to partially support roller tracks, generally indicated by the numerals 27, 27, which are positioned to either side of the door 24. Each of the roller tracks 27, 27 include a substantially vertical track section 28 (see FIG. 6) formed in vertical track framers 22, 22, a substantially horizontal track section 29 and transition track section 30 interposed therebetween. The roller tracks 27, 27, in a known manner, thus support and direct travel of the door 24 in moving from the closed vertical position depicted in FIG. 2, associated with vertical track sections 28, 28 of roller tracks 27, 27 through transition track sections 30, 30 to the open, horizontal position associated with horizontal track sections 29, 29 seen in FIG. 2. The ends of horizontal track sections 29, 29 displaced from the door 24 are joined and supported by a back bar 31 attached directly or indirectly to the ceiling or walls of a structure in which the door system 20 is installed. The back bar 31 may be attached to vertical track framers 22, 22 as seen in FIG. 2 when door system 20 is packaged for shipping. The horizontal track sections 29, 29 may be attached to the frame 21 as seen in FIG. 1 when the door 20 is packaged for shipping. Further, the counterbalance system 25 may be installed and tensioned in the packaged shipping condition seen in FIG. 1.

For exemplary purposes, an eight panel sectional door 24 is shown in FIGS. 1 and 2 of the drawings; however, it will be appreciated that more or less panels may be employed in sectional doors of this type depending upon the height of the door opening and related considerations. As depicted, the door 24 has a plurality of panels or sections, generally indicated by the numeral 40, including a first or top panel 41, a second panel 42, a third panel 43, a fourth panel 44, a fifth panel 45, a sixth panel 46, a seventh panel 47, and an eighth or bottom panel 48. Each of the panels 40 have generally the same essential configuration. Thus, only a single panel, panel 47, will be described in detail for exemplary purposes.

Figure 3:
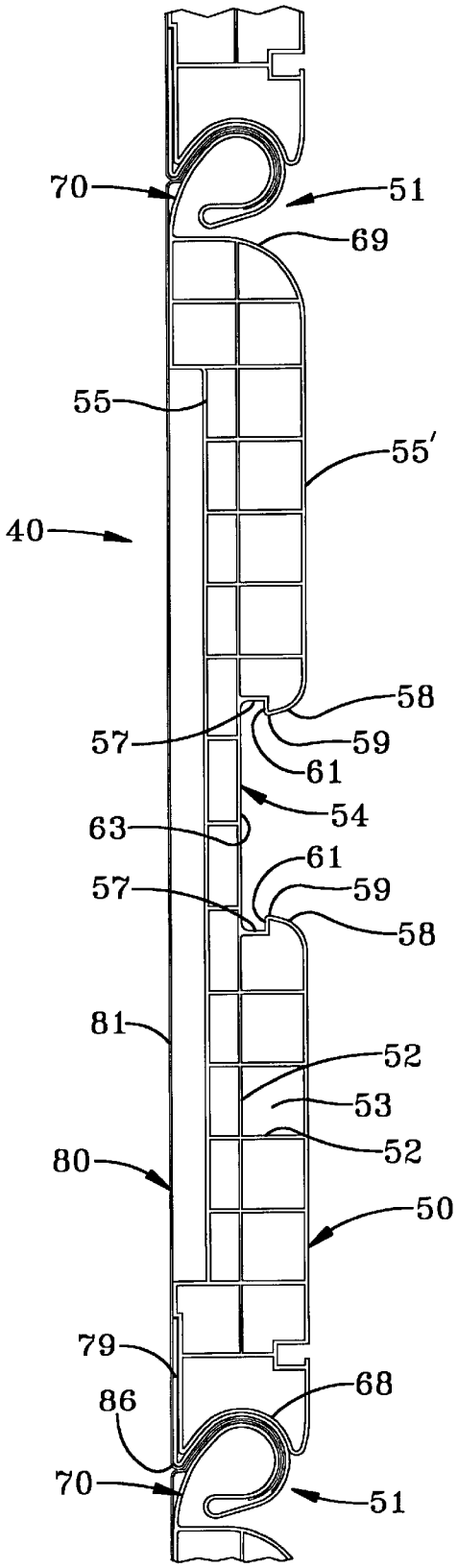
FIG. 3 is a fragmentary sectional side view taken substantially along line 3—3 in FIG. 2 depicting details of one section of the door including the corrugated door section body and the metal cladding.

As shown in FIG. 3, each panel 40 has a body portion, generally indicated by the numeral 50, with hinge elements, generally indicated by the numeral 51, located at the upper edge thereof. The body portions 50 are constructed of a polymeric material and have generally continuous outer surfaces. The body portions 50 may be extruded from thermoset or thermoplastic polymers or other suitable materials. The polymeric material preferably has a flex modulus similar to polypropylene resin so that the angular flexing of the hinge elements 51 described hereinafter during traverse through the transitional radius between the horizontal and vertical positions of the door can be accommodated without exceeding the flex memory of the polymeric material. One preferred material for the polymeric body portion 50 is a homopolymer polypropylene. While the height of body portions 50 may be in the 6 inch to 18 inch range, the height is preferably from approximately 9 inches to 12 inches, for purposes of permitting optimum radius curved transition track sections 30, 30.

Internally, the body portion 50 is preferably ribbed, honeycombed, or otherwise reinforced and segregated with internal dividers 52 that provide voids 53 between the surfaces of the door 24. The voids trap air between these surfaces providing an insulative break and reducing the rate of heat transfer between the surfaces of the door. It has been determined that these objectives can be met with a wide variety of internal structures with one example having the body portions 50 at least 0.75 inch in thickness with intersecting horizontal and vertical internal dividers 52 forming rectangular or square voids 53 having a width of at least 50% of the height or the thickness of body portion 50 and no more than 100% of the height of the voids 53.

As previously indicated, the exterior surfaces of the door 24 include a front surface 55 and a rear surface 55' which are generally continuous and may be provided with recesses or other surface characteristics as desired. The surface characteristics may be aesthetic or used functionally such as for mounting hardware in the nature of locks, windows, reinforcing members or rollers on or within the door 24. For example, a recess, generally indicated by the numeral 54, may be provided in the rear surface 55' of the door 24 to receive members used to secure stiles.

Figure 5:
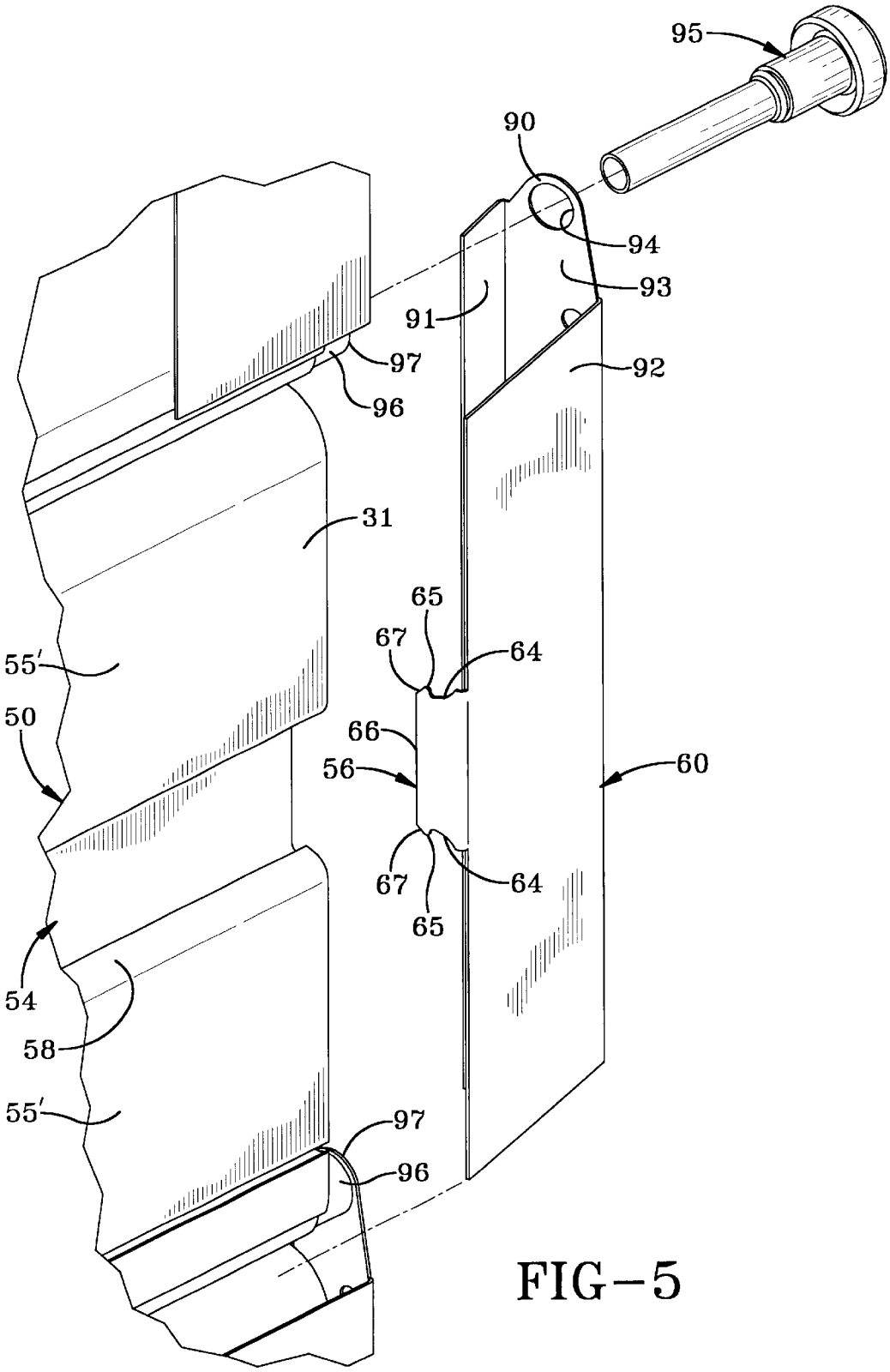
FIG. 5 is a fragmentary partially exploded perspective view depicting installation of the end stile and a roller into the body portion of the door.

As best seen in FIGS. 3 and 5, recess 54 is formed in the rear surface 55' of the door sections 40 for receiving a tab, generally indicated by the numeral 56, formed on an end stile, generally indicated by the numeral 60. The tab 56 and recess 54 are cooperatively formed such that the tab 56 may be insertably received within recess 54 and serve to hold the end stile 60 in place under normal operating conditions. Viewed axially from its open end (FIG. 3), recess 54 generally necks inward and then mushrooms laterally outward. As shown, the recess 54 is defined by opposed walls 57 including a pair of shoulders 58, 58 that taper inwardly to form a neck 59 of the opening 54. Lands 61 extend outwardly from the shoulders 58 at the neck 59 to the walls 57. The walls 57 extend substantially perpendicular to lands 61 and may join an internal rib 63 of the door section 40 to complete the recess 54. As shown, selected surfaces of these structures may be rounded to facilitate insertion of tab 56, such as, the shoulders 58 and the joint between walls 57 and the internal rib 63. The lands 61 are preferably left square to securely grip the tab and prevent any extent of movement thereof.

Referring to FIG. 5, it may be seen that tab 56 may be provided with corresponding features such that the tab 56 fits snugly within recess 54. In particular, tab 56 is provided with neck portions 64 that expands outwardly to form a head portions 65 that extend laterally outwardly beyond the necks 64. The leading edges 67, 67 of the head portions 65, 65 may be tapered inwardly to facilitate insertion and terminate in flats 66 which abuts rib 63. When inserted, head portions 65, 65 fit within the widened opening of recess 54 adjacent the walls 57 and lands 61. It will be appreciated that a single recess 54 may be formed to insertably receive the tab 56 in a snap-in type motion, or, as shown, recess 54 may extend axially in a channel-like fashion such that tabs 56 may be slidably inserted axially within the channel.

Further, the exterior surface 55 of the sections 40 may be provided at the lower and upper extremities with recessed lands 68, and rounded shoulders 69, respectively to interface with a portion of the hinge 51 extending between the adjacent door sections 40 to form a one piece door 24. The hinge 51 may be a separate member attached between the sections 40 or may be integrally formed with one of the sections 40. A plurality of hinges 51 might be spaced along the width of each door section 40 or hinge 51 may extend the entire width of the section 24 as shown herein.

As shown, hinge 51 is constituted in vertical cross-section primarily of a relatively large-radiused, deformable double loop, generally indicated by the numeral 70. As shown, the double loop may be a continuation of rounded shoulders 69 at the upper extremity of the sections 40 and therefore constituted of the same material having the flexing characteristics described hereinabove. Referring particularly to FIGS. 4A–4D, the double loop 70 of hinge 51 has an upper flat curve segment 71 which extends upwardly and inwardly from outer surface 55 of the body portion 50 of door sections 40. The upper flat curve segment 71 transcends into a semicircular segment 72 which is centered about an axis 73 which is preferably located substantially centrally of the thickness of the door sections 40. The semicircular segment 72 transcends into a lower flat curved segment 74 which is directed generally back toward the front surface 55 of door sections 40. Together the segments 71, 72, and 74 define the inner leg 75 of the double loop 70.

Figure 4B:
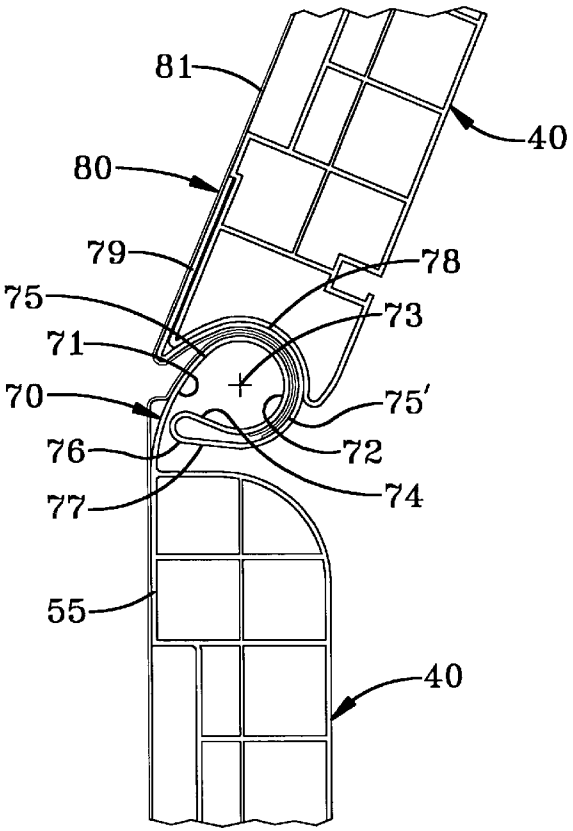
FIGS. 4A through 4D are a series of sectional side views similar to FIG. 3 depicting the door hinge and moving pivot points as adjacent door sections rotate relative to one another as the door moves through the transition portion of the tracks.
Figure 4A:
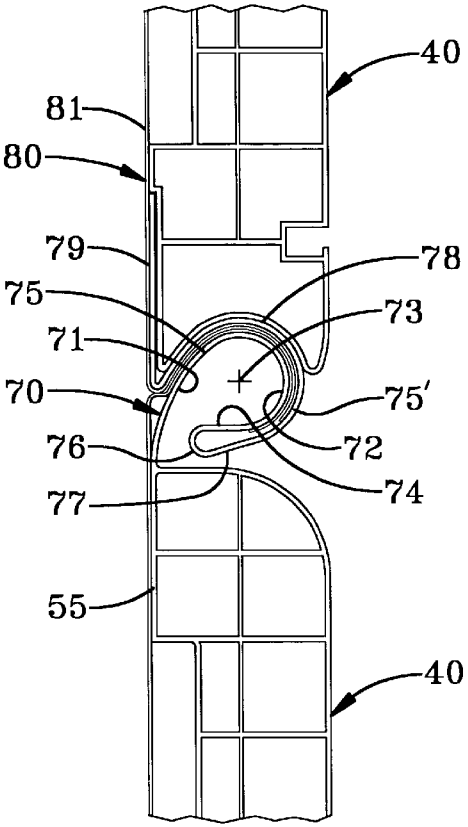

The double loop 70 has an outer leg 75' which, as can be seen in FIG. 4A, that is spaced from and substantially parallels the inner leg 75 when the sections 40 of sectional door 24 are in a substantially planar alignment. The legs 75 and 75' are connected by a hairpin curve return 76 which merges into a return lower flat curve segment 77 that substantially parallels the lower flat curved segment 74 of inner leg 75. The return lower flat curved segment 77 merges into a return circular segment 78 which parallels semicircular segment 72 and a portion of upper flat curve segment 71 of the inner leg 75. The outer leg 75' of double loop 70 terminates in an angularly upwardly disposed locking tab 79 which is located along a portion of the front surface 55 of the bottom of the door sections 40 and retained in a manner described hereinafter.

Figures 7A, 7B, 7C, 7D, 7E:
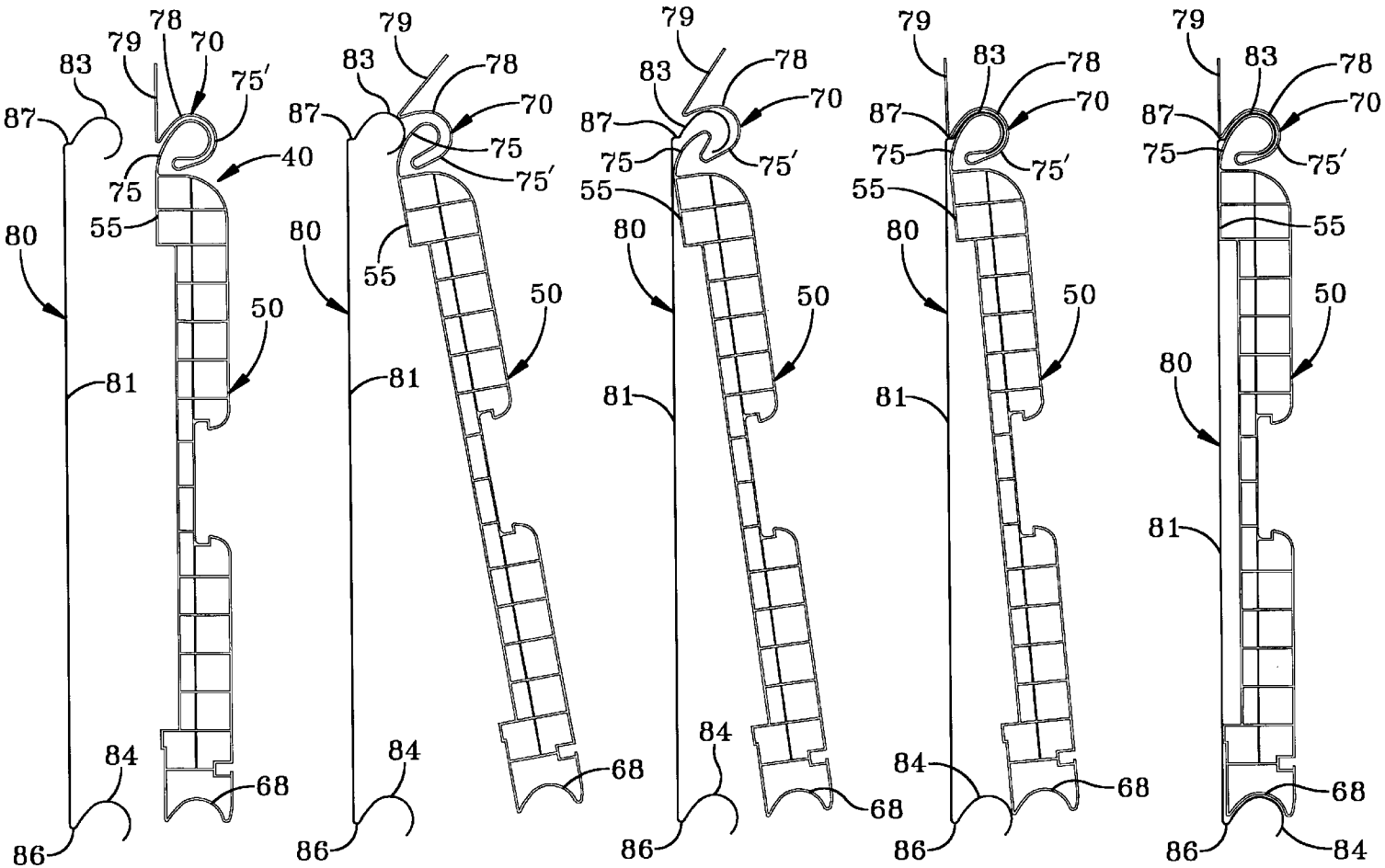
FIGS. 7A–7E are side elevational views depicting the sequence of steps in attaching the metal cladding to the body portion of the door.

The sections 40 of door 24 have a cladding, generally indicated by the numeral 80, which covers the front surface 55 of the body portions 50 and constitutes an operative portion of the hinge elements 51. The cladding 80 operates to provide rigidity to the sections 40 as well as protection from the elements. While the cladding 80 might be constructed of various materials to achieve the desired performance, a sheet metal of a type commonly used as facer material for sectional overhead doors is a satisfactory selection for the cladding 80. Referring particularly to FIGS. 3, 4, and 7, the cladding 80 for body portion 50 has a substantially planar front cover 81 which is adapted to overlie the front surface 55 of the body portion 50. The top and bottom edges of the cladding 80 as viewed in the figures have a first hook member 83 and a second hook member 84, respectively. As best seen from FIGS. 7A–7E, the first and second hook members 83, 84 are generally semicircular and preferably configured to mate with portions of inner leg 75 and outer leg 75' which encase the first and second hook members 83, 84. In particular, hook members 83, 84 generally conform to the circular segments 72 and 78 of inner leg 75 and outer leg 75', respectively, of the double loop 70. As best seen in FIGS. 3 and 4, the first hook member 83 at the top of a section 40 fits over and is adjacent to the upper flat curve segment 71 and a portion of semicircular segment 72 of inner leg 75. The second hook member 84 at the bottom of sections 40 conforms to the circular segment 78 of outer leg 75' interiorly thereof and outwardly of the first hook member 83 of an adjacent door section 40.

The installation of the cladding 80 on the body portion 50 of each door section 40 is effected in the manner depicted in FIGS. 7A–7E of the drawings. In FIG. 7A the cladding 80 is brought into a general alignment with the front surface 55 of body portion 15 of a door section 40. As seen in FIG. 7B the first hook member 83 is brought into contact with inner leg 75 and outer leg 75' of the resiliently deformable double loop 70 to produce a separation between the inner leg 75 and outer leg 75' as depicted in FIG. 7B. FIG. 7C depicts the inner leg 75 and outer leg 75' of the double hook 70 having been displaced a sufficient distance such as to receive the first hook member 83 within the confines thereof. In FIG. 7D, the second hook member 84 of cladding 80 is brought closer into alignment with body portion 50 such that inner leg 75 and outer leg 75' of double loop 70 return to the undistorted normal position thereof as depicted in FIG. 7A, except that first hook member 83 is interposed between the legs 75, 75'. Thereafter, the second hook member 84 is temporarily downwardly displaced from the normal position shown in FIG. 7D a sufficient distance to clear the land 68 at which time cladding 80 has the front cover 81 brought into engagement with the front surface 55 of body portion 50 which contemporaneously permits the second hook member 84 to snap into position against the complementary configured land 68 as seen in FIG. 7E.

With the cladding 80 assembled on body portion 50 a panel 40 is fully assembled and ready for attachment to an adjoining panel as seen in FIG. 3. In this respect, the double loop 70 of the lower of two panels has the outer leg 75' slid between the land 68 and the second hook member 84 while the locking tab 79 is simultaneously slid between front cover 81 of cladding 80 and the front surface 55 of body portion 50. As thus positioned the locking tab 79 as restrained by the front cover 81 of cladding 80 which retains the double loop 70 such as to maintain the adjacent door sections 40 in joined pivotal relationship as depicted in FIG. 3.

Figure 4D:
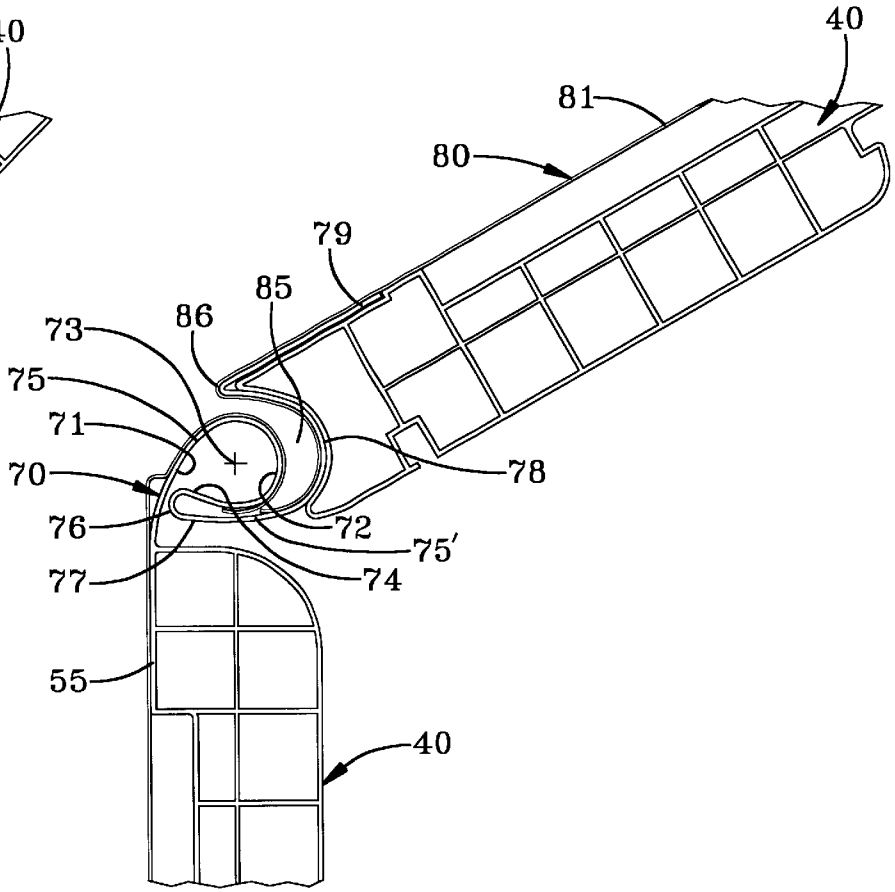
Figure 4C:
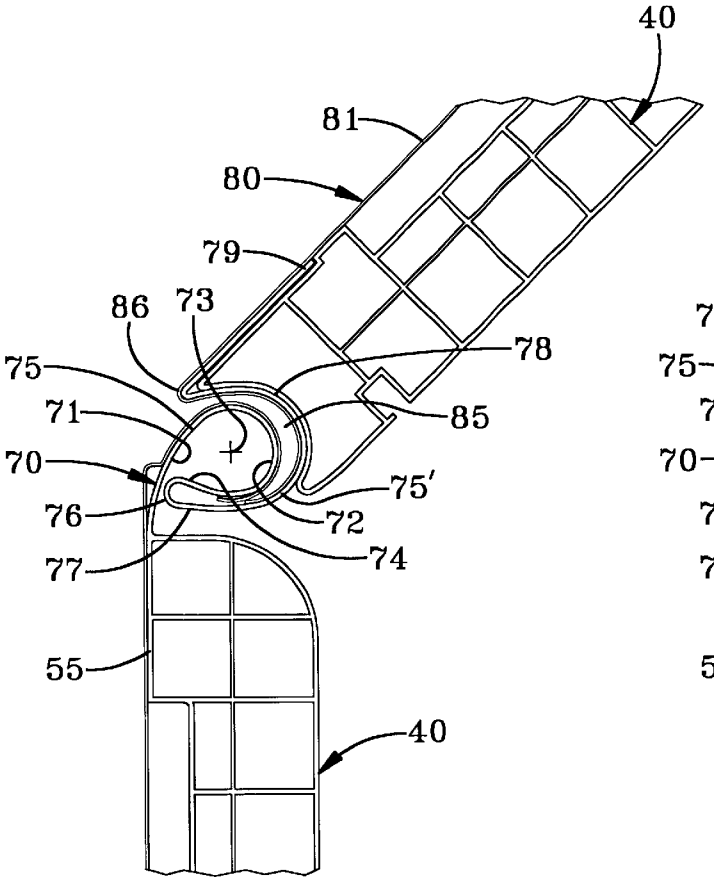

The operation of hinges 51 between adjacent panels 40 during movement of the sectional door 24 between the closed and open positions is best seen in FIGS. 4A–4D. FIG. 4A shows adjacent panels 40 in a planar position as would exist in the open or closed position of the door. FIGS. 4B–4D depict the angular inclination which takes place between adjacent panels 40 as the door transcends through transitional track sections 30joining the vertical track sections 28 and horizontal track sections 29, with a maximum angular orientation between adjacent panels 40 of approximately 75–80° being depicted in FIG. 4D.

The double loop 70 and the hook members 83, 84 are in a normal unstressed condition in the planar orientation of adjacent panels 40 as seen in FIG. 4A. As an angle develops between adjacent panels 40 during movement of the door 24 the hairpin curve return 76 pivots about axis 73 moving the hairpin curve return 76 to the left and upwardly as depicted in FIG. 4B. As the panels 40 experience progressively increasing angularity in moving to the positions depicted in 4C and 4D, the axis 73 and the hairpin curve return 76 retain substantially the same positions depicted in FIG. 4B. As the angularity between panels 40 increases between the orientation of FIG. 4B and the orientation of FIG. 4C, the return lower flat curved segment 74 and a portion of semicircular segment 72 of outer leg 75' straightens to an extent toward linearity such as to open a crescent-shaped gap 85 between the first hook member 83 and the second hook member 84. The flex modulus of the material of the flexible double loop 70 and the length of the segments 74, 72, which are the subject of the distortion, disperse the stress relief over a sufficient area such that the flex memory of the material of the outer leg 75' is not exceeded. In progressing from the angularity depicted in FIG. 4C to the maximum angularity of FIG. 4D the return lower flat curved segment 74 and semicircular segment 72 continue to straighten toward a linear orientation such that the crescent-shaped gap becomes larger as the second hook member 84 which remains relatively undistorted in essentially pivoting about hairpin curve return 76 may separate from the adjacent portion of outer leg 75' in the area of the transition between the return lower flat curved segment 74 and the return semicircular segment 72. A reverse progression from FIGS. 4D–4A takes place as the door 24 and particularly the adjacent panels 40 progress from the maximum angular displacement of 4D to the planar configuration of FIG. 4A.

It will be appreciated that the precise dimensions of the double loop 70 and the hook members 83, 84 of hinge element 51 may be configured such that no external or internal pinch points are created which could entrap a person's finger. More specifically, the hook members 83 and 84 of the cladding 80 remain in sufficiently close proximity during the entire pivotal movement of adjacent panels 40 such that the maximum separation between the nose 86 of cladding 80 and the first hook member 83 is at all times less than the maximum permissible separation specified by industry standards for a pinch-resistant configuration. As seen in FIG. 3, the cladding 80 may have an offset 87 at the transition between the front cover 81 and the first hook member 83 to receive the nose 86 so as to provide a flush front surface of cladding 80 of adjacent panels 40 at their juncture. The cooperative engagement of nose 86 with offset 87 also serves to prevent the transfer of moisture and air from the outside elements interiorly of the door 24.

Figure 6:
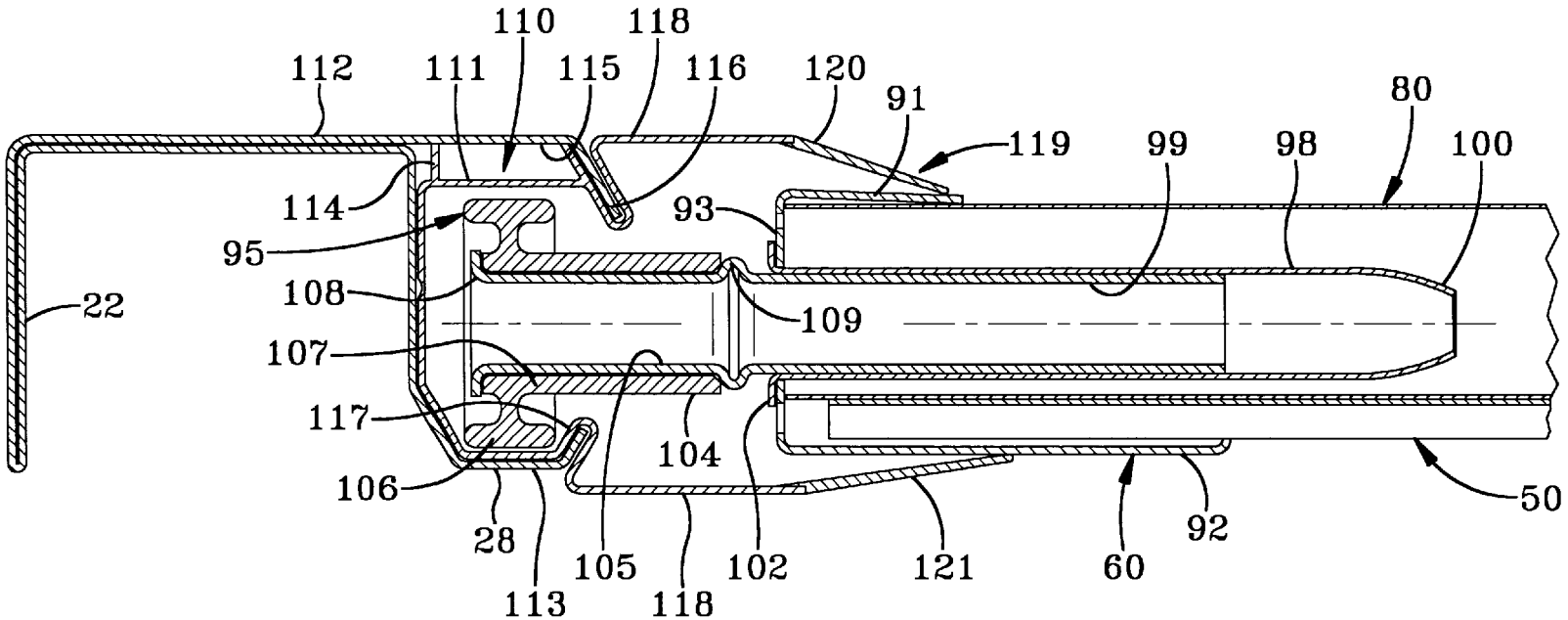
FIG. 6 is a fragmentary sectional view taken substantially along line 6—6 of FIG. 2 depicting the relationship of the roller tracks, end stile, and jambs of the door, together with the track liner.
Figure 9:
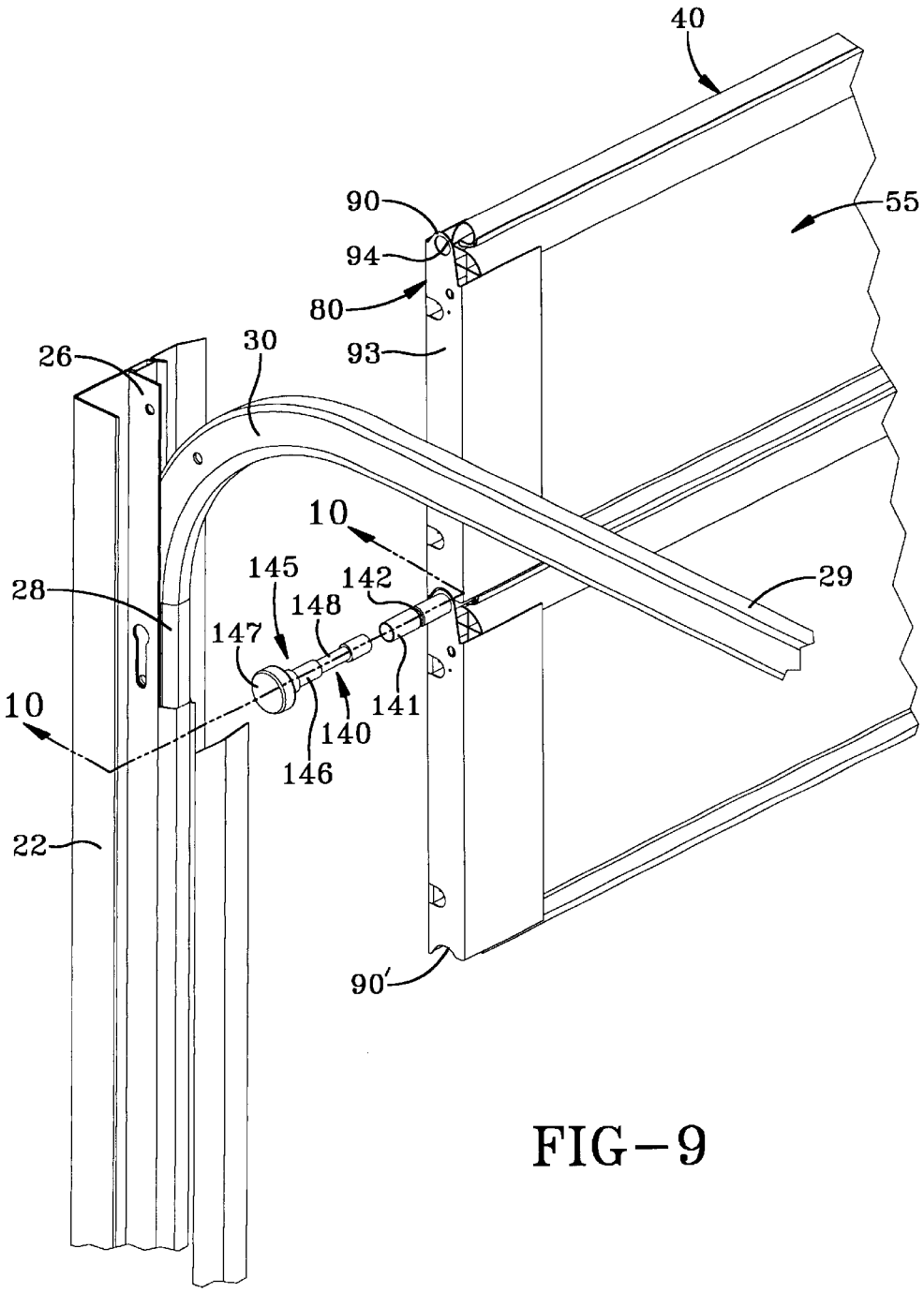
FIG. 9 is a fragmentary top end and rear view showing a modified roller assembly for wind-resistant applications in an exploded configuration.

In addition to cladding 80 covering the outer surface 55 of the door 24, the end stiles 60 may be installed to cover the ends 31 of the panels 40 of the door 24 and provide a planar exterior end surface. As shown in FIGS. 5 and 6, the end stiles 60 may be generally U-shaped members sized to cover the ends 31 of the door sections 40 and may include front and rear flanges 91 and 92 that extend at least partially over the front and rear surfaces 55, 55' of the door 24. As shown in FIG. 5, the rear flange 92 may extend inwardly to a greater extent than the front flange 91. To secure the end stile 60, the rear flange 92 may be provided with tab 56 designed to fit within recess 54 in the rear surface 55' of the door 24, as described above. To allow inward rotation of an upper adjacent section 40, the rear flange 92 extends vertically upwardly to a lesser extent than the front flange 91 (FIG. 5). In this way, a gap is created between adjacent end stiles on the rear surface 55' of the door 24. Front flange 91, on the other hand, extends nearly the entire length of the end 93 of stile 60, such that the adjacent stiles are in close proximity to each other on the front of door 24 when adjacent panels 40 are in planar orientation. As best shown in FIGS. 5 and 9, the end 93 of end stile 60 extends upwardly above front and rear flanges 91, 92 and has a rounded extremity 90 such that it may pivot within a rounded recess 90' formed at the lower portion of end 93 of an adjacent end stile 60. As best shown in FIG. 9, the end 93 of end stile 60 may be provided with an opening 94 to allow insertion of a roller assembly, generally indicated by the numeral 95, as will be described in detail below. In addition to providing a protective surface for the door 24, cladding 80 and end stiles 60 strengthen and stabilize the door 24.

To further strengthen the door 24 and reduce flexure of its sections 40, reinforcing members 96 may be inserted within the voids 53 between the internal dividers 52 of the door 24 or within the double loop 70 of hinges 51. In the embodiment shown, the reinforcing rod or tube 96 is inserted within the double loop 70 of hinges 51 and extends substantially the entire width of the door 24. As shown in FIG. 5, the reinforcing rod 96 may extend slightly beyond the width of the door 24 at either side thereof. The reinforcing member 96 may be inserted before installation of the end stiles 60 such that the end member 93 of end stile 60 abuts the exposed end 97 of the reinforcing member 96.

Roller assembly 95 may be inserted into the double loop 70 of the hinge member 51 or may be inserted into the reinforcing member 96. As shown in FIG. 6, a cylindrical reinforcing member or insert 98 may be located in a section 40, within the hinge 51, and sized to receive a roller shaft 99 of roller assembly 95 therein. As shown, the insert 98 may have a tapered end 100 to facilitate placement of the insert 98 within the hinge 51. At its opposite end, the insert 98 is provided with an annular flange 102 extending radially outwardly from the end of the insert 98. This flange 102 may rest adjacent to the end 31 of door section 40 and preferably against the outside surface of end 93 of stile 60.

While the reinforcing member 96 is a convenient location to insert a roller assembly 95, it is to be appreciated that the roller assembly 95 may be inserted into recesses formed within the side of the door 24 or in the spaces between the internal dividers 52 at the ends 31 of the door sections 40. Additionally, the roller 95 may be directly inserted inside the hinge 51.

FIG. 6 shows mounting of the roller assembly 95 at the hinge 51 inside an insert 98. The roller assembly 95 includes a roller body 104 journaled to a roller shaft 105. The roller body 104 includes a roller wheel 106 that extends radially outwardly from a collar 107 and may be integrally formed with the collar 107. To restrict axial movement of the roller body 104, relative to roller shaft 105, the roller shaft 105 may be provided with an annular flange 108 at its outermost extremity and a radially upstanding annular rib 109 spaced axially inwardly therefrom, such that the roller body 104 rests between the projecting surfaces of the flange 108 and rib 109. The annular rib 109 also prevents over insertion of the shaft 105 within the insert 102 by being sized larger than the corresponding opening within the insert 98 receiving roller shaft 105. As shown in FIG. 6, the roller assembly 95 may be inserted externally of the end stile 60, and the annular rib 109 may reside outside the exterior surface thereof. As shown, the roller shaft 105 is axially movable while the wheel 106 rotates about the shaft 105 within the roller track 27, to accommodate variations in roller track 27 or the spacing between tracks 27, 27 to either side of door 24 at different locations.

To reduce noise generated by the roller assemblies 95, a liner, generally indicated by the numeral 110, preferably made of polymeric material, may be inserted within the roller track 27 and may further wrap around the track surfaces and extend to partially cover the end stiles 60 of the door 24 as best seen in FIG. 6. In this way, the sound from the contact between roller wheel 106 and roller track 27 is first attenuated by eliminating contact between the roller wheel 106 and roller track 27 and further by encapsulating the roller assembly 95 to isolate the sound. By overlapping the end stiles 60 of door 24, liner 110 further prevents entry of fingers and other foreign objects at the sides of the door 24, while providing a weather seal and assisting in stabilizing the door.

As best shown in FIG. 6, the liner 110 generally includes an insert portion fitting within the roller track 27, a cover portion bridging the space between roller track 27, door 24, and a sealing portion overlying the stiles 60. The first portion or insert portion 111 is sized to fit within the roller track 27 and has a substantially C-shaped cross-section for receiving the roller 104 and conforming to the roller track 27. In the embodiment shown, the metal roller track 27 is not symmetrical, and has an outer track flange 112 and an inner track flange 113. Since, as shown, the roller wheel 106 is substantially smaller than the space between the flanges 112, 113 of roller track 27, the liner 110 is provided with a spacer 114 extending outwardly from the generally C-shaped insert portion 111 to contact the interior surface 115 of the flange 112. In this way, the C-shaped insert member 111 may be made to more closely conform to the dimensions of a particular roller wheel 106. Otherwise, the insert 111 generally conforms to the surfaces of the track 27 and wraps around the ends 116, 117 of the track flanges 112, 113.

Front and rear planar cover portions 118 extend from track flanges 112, 113, respectively, toward door 24 and are spaced a distance therefrom so as not to intrude upon the operation of the door 24. Coverage of this area prevents foreign objects from intruding upon the function of the door 24 and constitutes a pinch guard for persons working on or in proximity to the door 24 when it is opening or closing.

Vertical seal portion, generally indicated by the numeral 119, preferably includes front and rear flanges 120 and 121, respectively, that extend inwardly from the cover portions 118 and 118', respectively, to substantially overlie stile 60 of the door 24. The flanges 120, 121 taper inwardly toward the door and preferably contact the front and rear surfaces 91 and 92, respectively, of the end stile 60. The front flange 120 serves primarily as a weather seal, while the rear flange 121 constitutes a finger shield.

As shown in FIGS. 1, 2 and 9, the liner 110 generally extends the entire length of vertical track sections 28 of roller track 27. The rear flange 121, however, does not extend the full height of vertical track section 28 and is stopped short of the top of vertical track section 28 near transition track section 30. This allows the door sections 40 to bend or otherwise freely move inwardly as they move from the vertical closed position to the horizontal open position. If desired, the transition track sections 30 and horizontal track sections 29 may be provided with the insert portion of liner 110 for purposes of abating noise.

When it is desired to design a door system 20 for utilization in an environment having minimal overhead clearance it is possible to employ a pivoting operator, generally indicated by the numeral 125, which has the capability of effecting final closing and locking of a door 24. Such an operator is described in Applicant's Assignee's application Ser. No. 09/081,419, now U.S. Pat. No. 6,112,799. The operator 125 may be installed and in the locked position for shipping as seen in FIG. 2.

Figure 8:
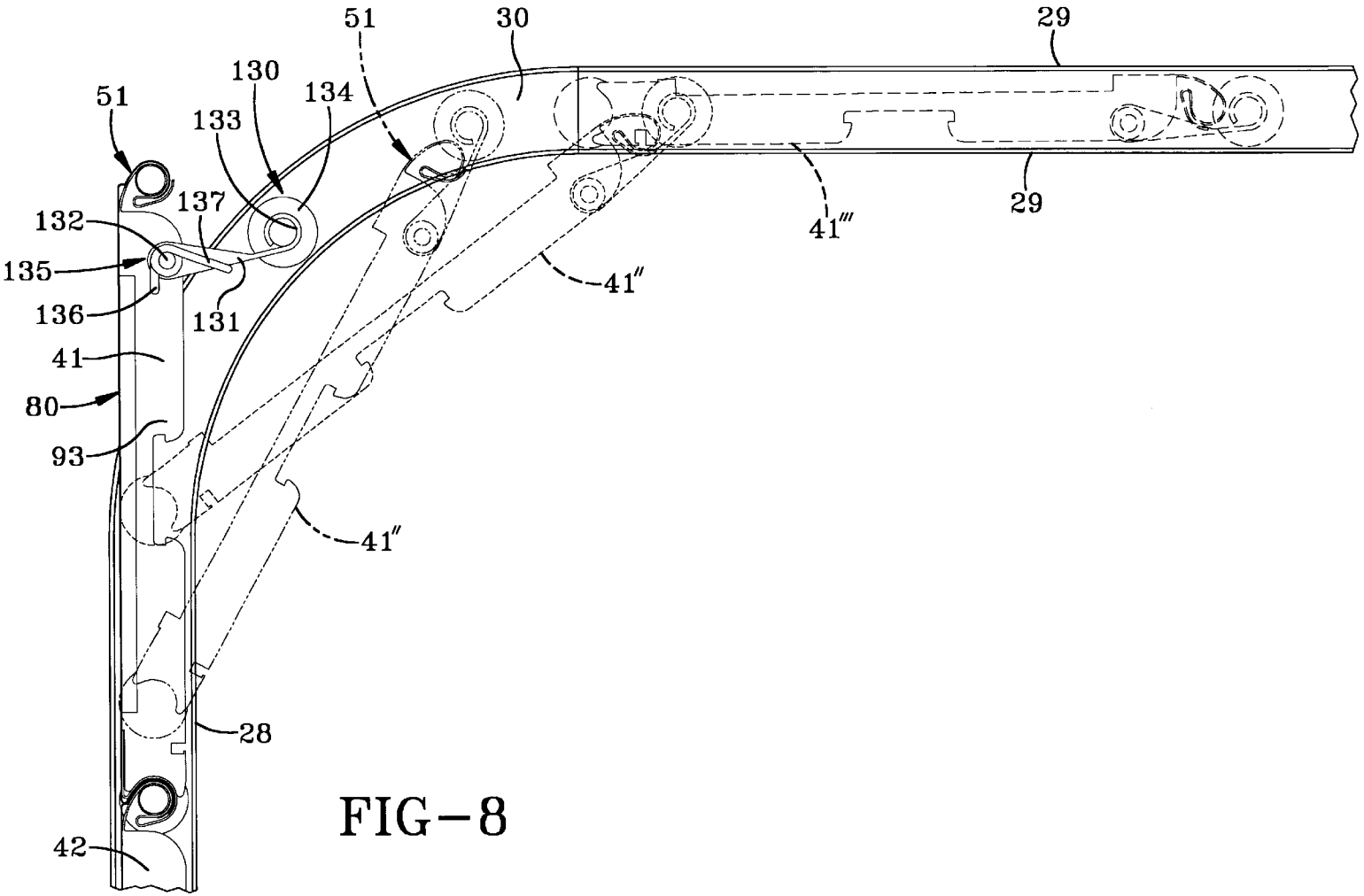
FIG. 8 is a fragmentary partially schematic side elevational view depicting the movement of the top panel of the door and showing the spring loaded rotating roller arm at the closed position of the door, the open position of the door and intermediate positions.

In the instance of use of a pivotal operator 125, the uppermost section 41 of the door 24 may be provided with a pivoting roller, generally indicated by the numeral 130, instead of a conventional fixed roller. Pivoting roller 130 has an arm 131 which in turn is rotatably mounted to the top door section 41. As best seen in FIG. 8, this roller assembly 130 may be attached directly to the end 93 of cladding 80 by a milford pin 132 about which arm 131 may rotate. The arm 131 mounts a shaft 133 on which a roller wheel 134 is freely rotatably mounted. The roller wheel 134 of pivoting roller 130 follows the track 27 as door 24 moves between the open and closed positions. When in the closed position, with the door sections 40 in generally vertical alignment, the pivotal roller 130 rests within a transition track section 30 of the roller track 27 and has the arm 131 oriented in a substantially horizontal direction or generally perpendicular to the door section 41. As the door 24 is initially opened to the position indicated as 41' in FIG. 8, the arm 131 of roller 130 pivots to assume a configuration substantially in planar alignment with door section 41. Thus, the arm 131 of pivotal roller 130 is of such a length and positioned so shaft 133 of the roller 130 is located upwardly of the top of the door 24.

To ensure the rotation of the arm 131 to the aligned position 41' during initial opening of the door the roller arm 131 may be spring biased toward the vertical, aligned position. To this end, a torsion spring 135 is coiled about milford pin 132 and has a first leg 136 attached to end 93 of cladding 80 and a second leg affixed below arm 131 or shaft 133. It is to be appreciated that configured as described, the operator 125, horizontal track sections 29 and door 24 all operate at or below the top of the header frame 23 such that no headroom clearance is required above header frame 23. The arm 131 and roller 134 remain in alignment as the roller 134 of panel 41 moves from the transition track section 30 into the horizontal track section 29 indicated as position 41" and subsequently to the horizontal orientation of panel 41 indicated as position 41'" in FIG. 8. Thus, with the pivoting roller 130, the top of the top door section 41 never projects above the horizontal track section 29.

Figure 10:
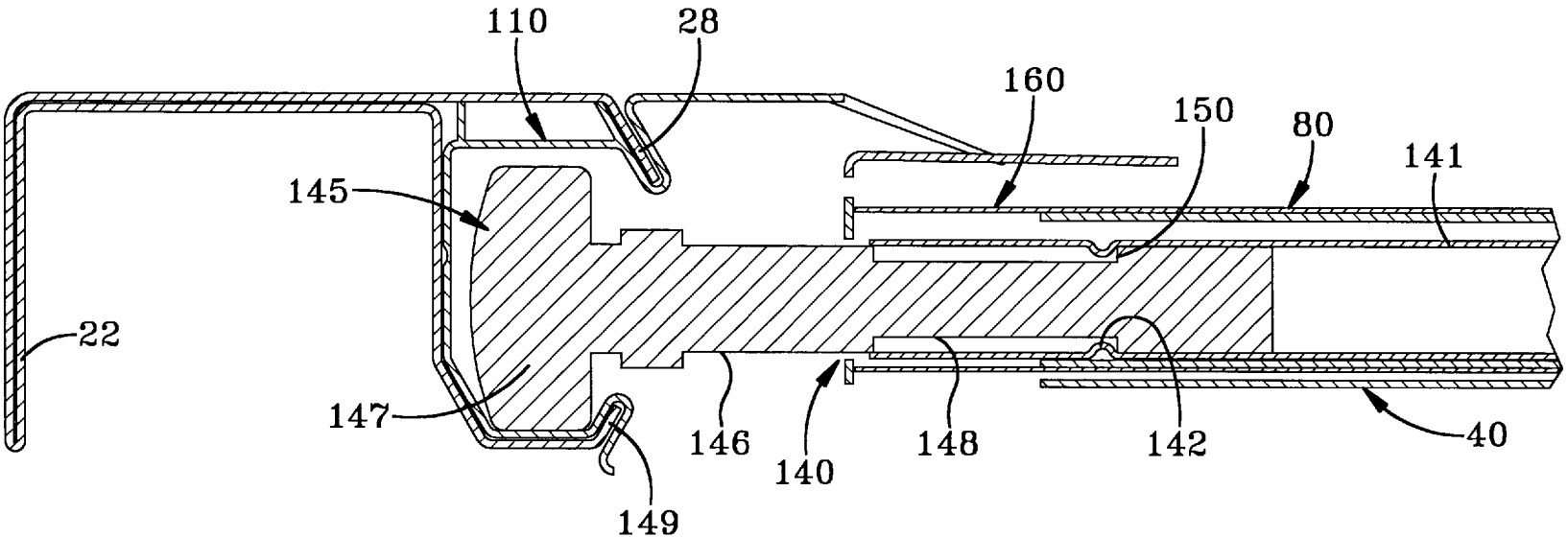
FIG. 10 is a fragmentary sectional view taken substantially along the line 10—10 of FIG. 9 showing the modified roller assembly and its relation to a reinforcing member and a vertical track section.

The door system 20 may be readily modified to provide wind-resistant characteristics by incorporating the teachings of applicants' assignees' U.S. application Ser. No. 09/081,419, now U.S. Pat. No. 6,112,799, which is incorporated herein by reference. An exemplary form of modified roller mounting to embody such wind-resistant characteristics is generally indicated by the numeral 140 in FIGS. 9 and 10. As shown, a reinforcing member 141 is inserted within the double loop 70 of hinges 51 and extends substantially the entire width of the panels 40 of the door 24. The reinforcing member 141 has a circumferential indented rib 142 located proximate each end thereof, one of which is shown in FIGS. 9 and 10.

The reinforcing member 141 receives a roller assembly, generally indicated by the numeral 145. The roller assembly includes a roller shaft 146 and a roller wheel 147 and related structure which may be substantially according to the roller assembly 95. Roller assembly 145 differs from roller assembly 95 in that the roller shaft 146 has an annular groove 148 which extends a distance axially thereof.

In conjunction with roller mounting 140, the vertical track sections 28 of roller tracks 27, which are normally substantially vertical and parallel to the ends to the end 93 of cladding 80, except for being slightly outwardly inclined from bottom to top to seat door 24 at closure, are also angled outwardly at a small oblique angle in accordance with the aforesaid U.S. patent application Ser. No. 09/081,419 filed. Placement of the vertical track sections 28 so angled contemplates the upper extremities being closest to the door 24, the lower extremities of track sections 28 being the greatest distance from the door 24 and intermediate locations on track sections 28 being downwardly at progressively greater distances from the door.

It will be appreciated that the rib 142 and groove 148 are located relative to the track sections 28 such that each roller 147 is in axial pressure engagement with an inner retaining leg 149 of track 28 or the overlying liner 110 when the door is in the closed vertical position. This results from rib 142 engaging the axially inner end 150 of groove 148 just prior to the door 24 reaching the closed position. The rib 142 is variously positioned in groove 148 displaced from inner end 150 of groove 148 during opening and closing of the door. Thus, when door 24 is in the closed position the roller assembly 145 and reinforcing members between each of the panels 40 are tension-loaded to resist buckling of the panels under applied wind and pressure forces.

Figure 11:
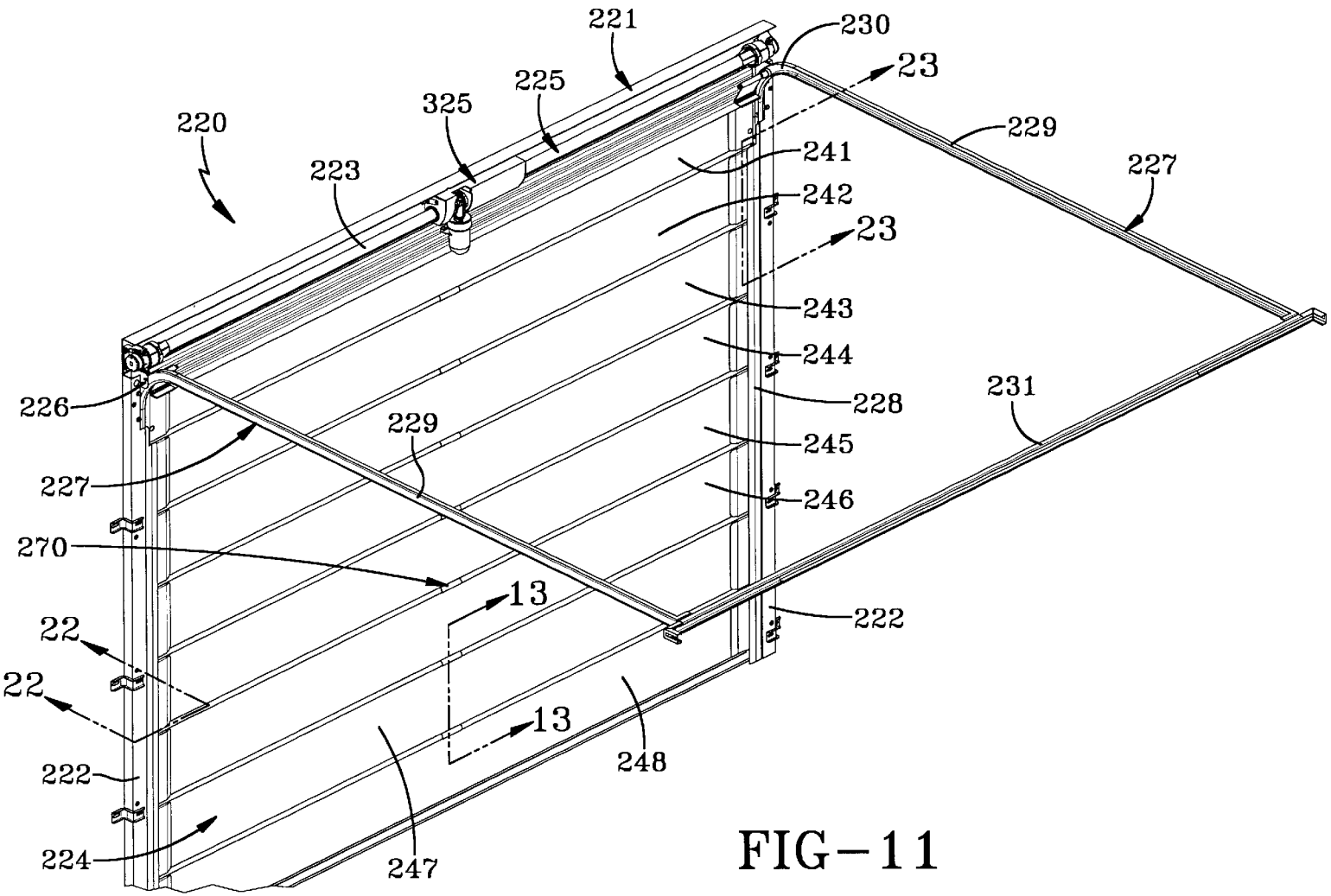
FIG. 11 is a perspective view depicting an alternate, pan door embodiment of upward acting sectional door embodying concepts of the present invention as it might be installed with the horizontal tracks in operative position and braced with a back bar.

An upward acting insulated or uninsulated sectional pan door system embodying the concepts of the present invention is generally indicated by the numeral 220 in FIG. 11 of the drawings. The door system 220 is positioned and mounted for opening and closing movement in a building or trailer by a peripheral door frame, generally indicated by the numeral 221. The frame 221 consists of a pair of spaced vertical track framers 222, 222 that, as seen in FIG. 11, are generally parallel and extend vertically upwardly relative to a supporting surface such as floor or the bed of a trailer (not shown). The vertical track framers 222, 222 are spaced and joined proximate their vertical upper extremity by a header framer 223 to thereby define the generally inverted U-shaped frame 221 for mounting a door, generally indicated by the numeral 224. The frame 221 may be constructed of metal or other relatively high-strength, rigid material for purposes of reinforcement, attachment to a building or vehicle, and facilitating the attachment of elements involved in supporting and controlling the door 224.

Figure 12:
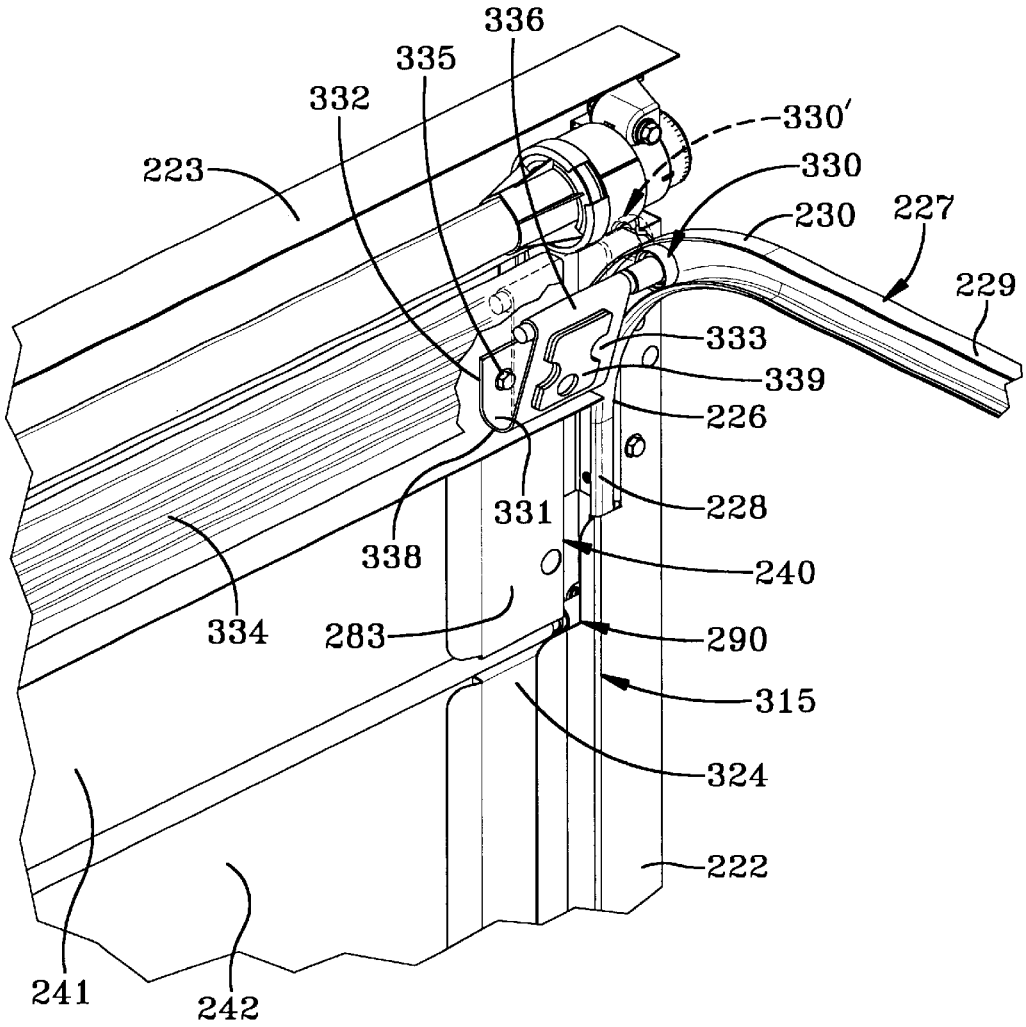
FIG. 12 is an enlarged fragmentary perspective view of the upper corner of the door of FIG. 11 showing particularly the pivotal roller assembly mounted proximate the top of the door.

The header framer 223 may advantageously mount a counterbalance system, generally indicated by the numeral 225, that interacts with the door 224 to facilitate raising and lowering the door 224 in a manner well known to persons skilled in the art. The counterbalance system 225 may be in accordance with the characteristics of the counterbalance system described hereinabove in conjunction with the counterbalance system 25. As seen in FIGS. 11 and 12, flag angles 226, 226 are provided to partially support roller tracks, generally indicated by the numerals 227, 227, which are positioned to either side of the door 224. Each of the roller tracks 227, 227 includes a substantially vertical track section 228 formed in vertical track framers 222, 222, a substantially horizontal track section 229 and a transition track section 230 interposed therebetween. The roller tracks 227, 227 in a known manner thus support and direct travel of the door 224 in moving from the closed vertical position depicted in FIG. 11 associated with vertical track sections 228, 228 of roller tracks 227, 227 through transition track sections 230, 230 to the open, horizontal position associated with horizontal track sections 229, 229 seen in FIG. 11. The ends of horizontal track sections 229, 229 displaced from the door 224 are joined and supported by a back bar 231 attached directly or indirectly to the ceiling or walls of a structure in which the door system 220 is installed. It will be appreciated that the door system 220 of FIG. 11 may be packaged for shipping with the back bar 231 and the horizontal track sections 229, 229 disassembled and positioned in relation to the door 224 in the same manner as is depicted in FIG. 1 of the drawings with respect to the door system 20.

For exemplary purposes, an eight-panel sectional door 224 is shown in FIG. 11 of the drawings; however, it will be appreciated that more or less panels may be employed in sectional doors of this type depending upon the height of the door opening and related considerations. As depicted, the door 224 has a plurality of panels or sections, generally indicated by the numeral 240, including a first or top panel 241, a second panel 242, a third panel 243, a fourth panel 244, a fifth panel 245, a sixth panel 246, a seventh panel 247 and an eighth or bottom panel 248. Each of the panels 240 has generally the same essential configuration. Thus, only a single panel, panel 245 will be discussed in detail for exemplary purposes.

Figure 13:
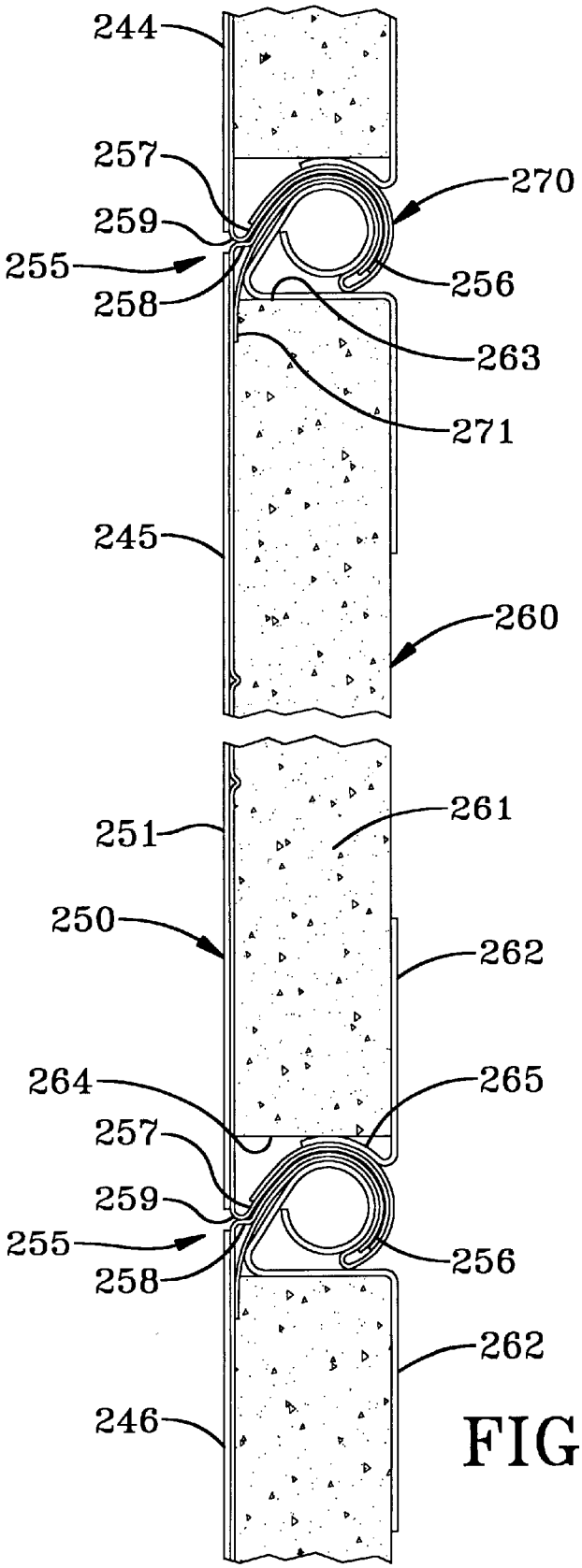
FIG. 13 is an enlarged fragmentary sectional view taken substantially along line 13—13 of FIG. 11 through a panel and top and bottom pivotal closure assemblies at the location of coupler clips.

As shown in FIG. 13, each of the panels 240 of pan door system 220 has as a primary structural member a facer, generally indicated by the numeral 250, having a front surface 251 which may be essential planar and extend substantially the height and width of the panels 240. The top and bottom of front surface 251 of facers 250 transcend into pivotal closure assemblies, generally indicated by the numeral 255, that include a first hook member 256 and second hook member 257 at the top and bottom edges, respectively, of the facers 250. The first and second hook members 256, 257 are generally semicircular and are preferably formed of substantially the same radius such that the second hook member 257 at the bottom of panel 244 encompasses the first hook member 256 at the top of panel 245 as seen in FIG. 13. The facer 250 may also have an offset 258 between the front surface 251 and the first hook member 256 at the top of the panels 240. At the bottom of each of the panels 240 the facer 250 has a projecting nose 259 located between the front surface 251 and the second hook member 257. In this respect, when adjacent panels 240 are in a planar orientation as when the door 224 is in a closed position the nose 269 abuts the offset 258 such that a flush front surface of facers 250 of adjacent panels 240 is formed at their juncture. This cooperative engagement of nose 259 and offset 258 also serves to prevent the transfer of moisture and air from the outside elements to the space interiorly of the door 224.

If desired to reduce transmission of heat and cold through the door and/or to reduce noise, the panels 240 may be provided with an insulation layer, generally indicated by the numeral 260. The insulation layer 260 includes a foam body 261 which may be any of the polyurethane or polystyrene foaming materials commonly employed in the insulation of garage doors and the like. The insulation layer 260 may also advantageously have a backer 262 which may be of a metallic foil or paperboard material which may serve to protect the foam 261 from excessive moisture absorption or damage if contacted by a foreign object. Insulation layer 260 is preferably sized so that a top edge 263 and a bottom edge 264 are not exposed from the back of the door. To this end, the top edge 263 extends within the interlaced first and second hook members 256, 257 as seen in FIG. 13. The bottom edge 264 of insulation layer 260 for each panel 240 is wedged against the second hook member 257, as also seen in FIG. 13. To ensure retention and enclosure of foam layer 261 at its bottom edge 264, a projecting flap 265 of the backer 262 may extend over at least a portion of bottom edge 264 and engage the second hook member 257 of the pivotal closure assemblies 255. Thus, the top and bottom edges 263, 264 of insulation layer 260 are tucked under the pivotal closure assemblies 255 of facer 250 over substantially the entire lateral width of the panels 240. As will be seen hereinafter, the lateral extremities of insulation layer 260 are also confined such that all four edges of the insulation layer 260 are shielded from exposure inwardly of the panels 240.

While the panels 240 are interconnected substantially throughout their lateral extent solely by the pivotal closure assemblies 255 except for hinge areas at the ends thereof described hereinbelow, the door 224 may be provided with coupler elements, generally indicated by the numeral 270 in FIGS. 11, 13 and 14. While a single coupler 270 is shown between each of adjacent panels 240 substantially medially of the lateral extent thereof, it is to be appreciated that additional coupler elements 270 could be employed at selected locations depending upon the width of the door 224.

Figure 14A:
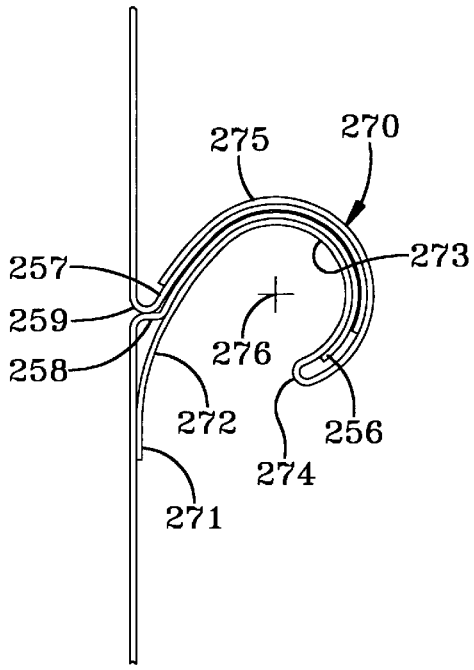
FIGS. 14A through 14D are a series of side views similar to FIG. 13 depicting positions of the pivotal closure and the coupler clips between panels as adjacent door panels rotate relative to one another as the door moves through the transition portion of the tracks.

The coupler elements 270 are shown in the form of a clip 271 having a deformable double loop which bears some similarity to the double loop 70 of door system 20 described hereinabove. The clip 271 has a flat curved segment 272 which transcends into an inner semicircular segment 273. The inner semicircular segment 273 is connected by a hairpin curve return 274 to an outer semicircular segment 275 which is positioned substantially equidistant from the inner semicircular segment 273 throughout its extent when adjacent door panels 240 are in planar alignment as seen in FIGS. 13 and 14A. Both the inner semicircular segment 273 and the outer semicircular segment 275 are centered about a pivot axis 276 which remains substantially fixed relative to panels 240. The inner semicircular segment 273 and the outer semicircular segment 275 are spaced and configured such as to accommodate both first hook member 256 and second hook member 257 of the pivotal closure assemblies 255 when operatively juxtaposed. The coupler element 270 may be constructed of a selected sheet steel or a polymeric material of the type described above in conjunction with the body portions 50 of door system 20.

Figure 14B:
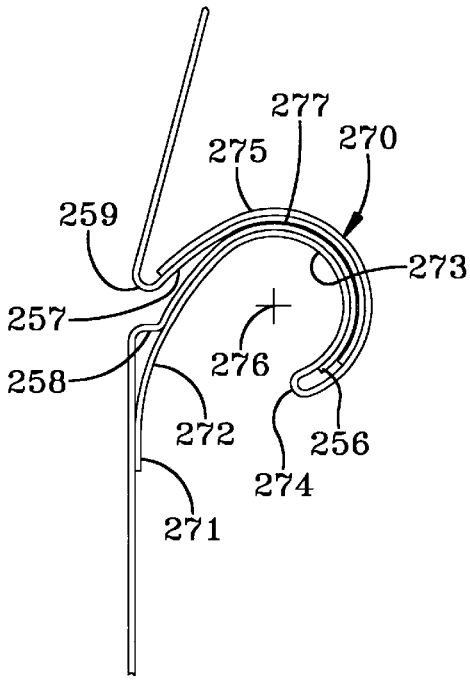
Figure 14C:
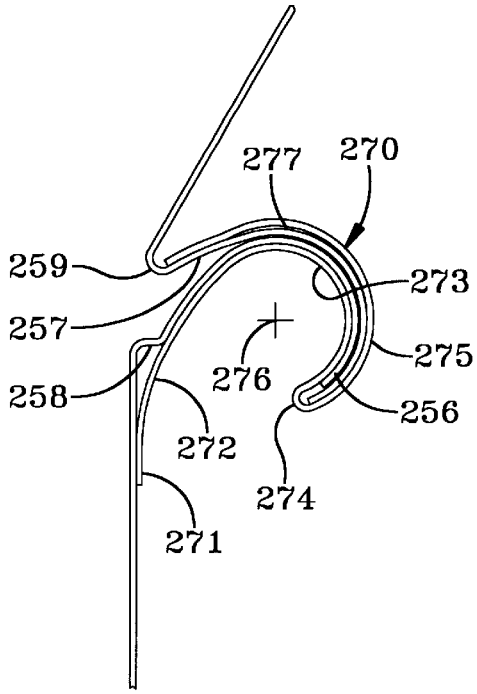
Figure 14D:
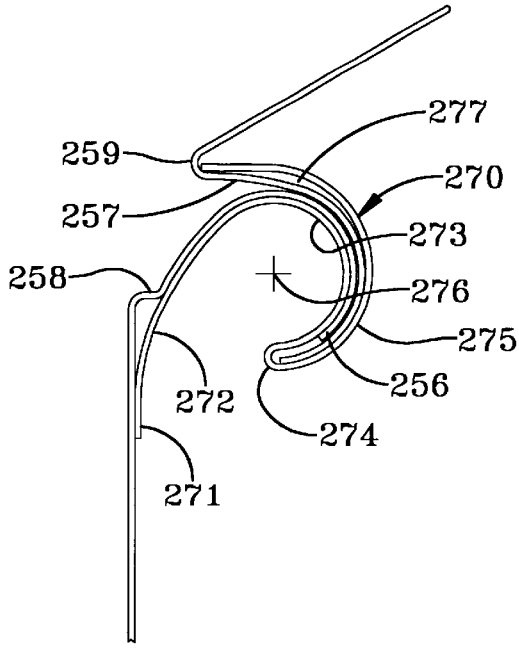

The operation of the coupler elements 270 in relation to the pivotal closures assembles 255 of panels 240 during movement of sectional door 224 between the closed and open positions is been seen in FIGS. 14A–14D. FIG. 14A shows adjacent panels 40 in a planar position as would exist in the open or closed position of the door. FIGS. 14B–14D depict the angular inclination which takes place between adjacent panels 240 as the door transcends through transition track sections 230 joining the vertical track sections 228 and horizontal track sections 229, with a maximum angular orientation between adjacent panels 240 for the small-radius transition track sections 230 being approximately 75–80 degrees as depicted in FIG. 14D.

The coupler element 270 and the first and second hook members 256, 257 are depicted in a normal, unstressed condition in the planar orientation of adjacent panels 240 as seen in FIG. 14A. As an angle develops between adjacent panels 240 during movement of the door 224 the hairpin curve return 274 moves about the pivot axis 276 displacing the hairpin return curve 274 to the left and upwardly, as is progressively depicted in FIGS. 14B–14D. In the position of FIG. 14B the first hook member 256 and second hook member 257 begin to separate in the areas proximate to the offset 258 and the nose 259, while a crescent-shaped gap opens between the outer semicircular segment 275 of clip 271 and the second hook member 257 of pivotal closure assembly 255. The separation of the first and second hook members 256, 257 and the size of the gap becomes progressively larger as the panels 240 move to the relative positions depicted in FIGS. 14C and 14D. As in the case of the hinge 51 of the door system 20 the stress relief is dispersed over a sufficient area of the clip 271 and hook members 256, 257 such that the materials are not distorted beyond their flex memory whereby the return of the door from the position of FIG. 14D to that of FIG. 14A restores the original configuration of coupler elements 270 and pivotal closure assemblies 255 of panels 240.

As in the case of the door system 20, the door system 220 has the pivotal closure assemblies 255 and coupler elements 270 configured such that no external or internal pinch points are created which could entrap a person's fingers. More particularly, the first and second hook members 256, 257 of pivotal closure assemblies 255 remain in sufficiently close proximity during the entire pivotal movement of adjacent panels 240 such that the maximum separation between the nose 259 and the first hook member 256 is at all times less than the maximum permissible separation specified by industry standards for a pinch-resistant configuration. Thus, the pivotal closure assemblies 255 throughout their length provide a pinch-resistant configuration. Further, since the movements of the components of the pivotal closure assembly 255 are essentially pivotal about the pivot axis 276 or by separation of hook members 256, 257, the coupler elements 270 function to stabilize the pivot axis 276 of the pivotal closure assemblies 255 about the pivot axis of the panel hinges described hereinbelow during operation and to assist in assembly of the door 224.

Figure 16:
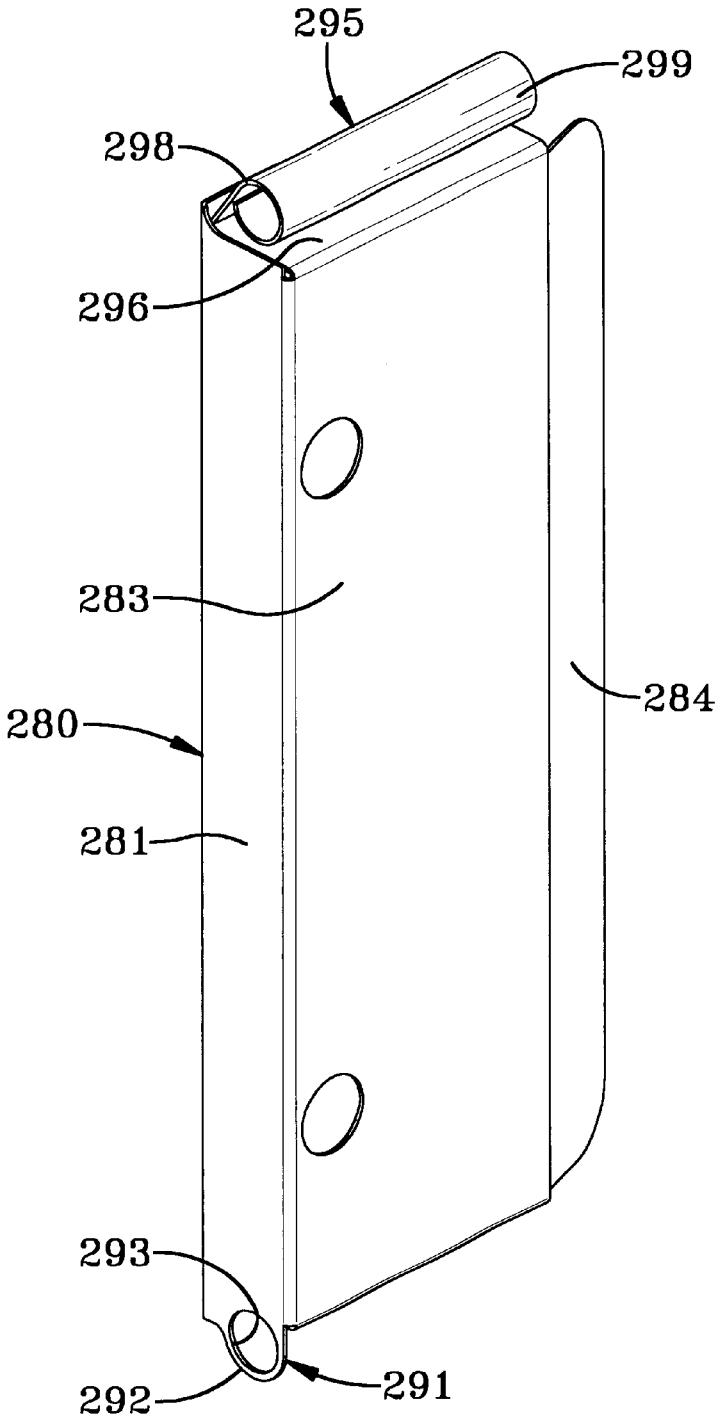
FIG. 16 is an enlarged rear perspective view of an end stile for the door of FIG. 11 showing the top and bottom hinge elements.
Figure 17:
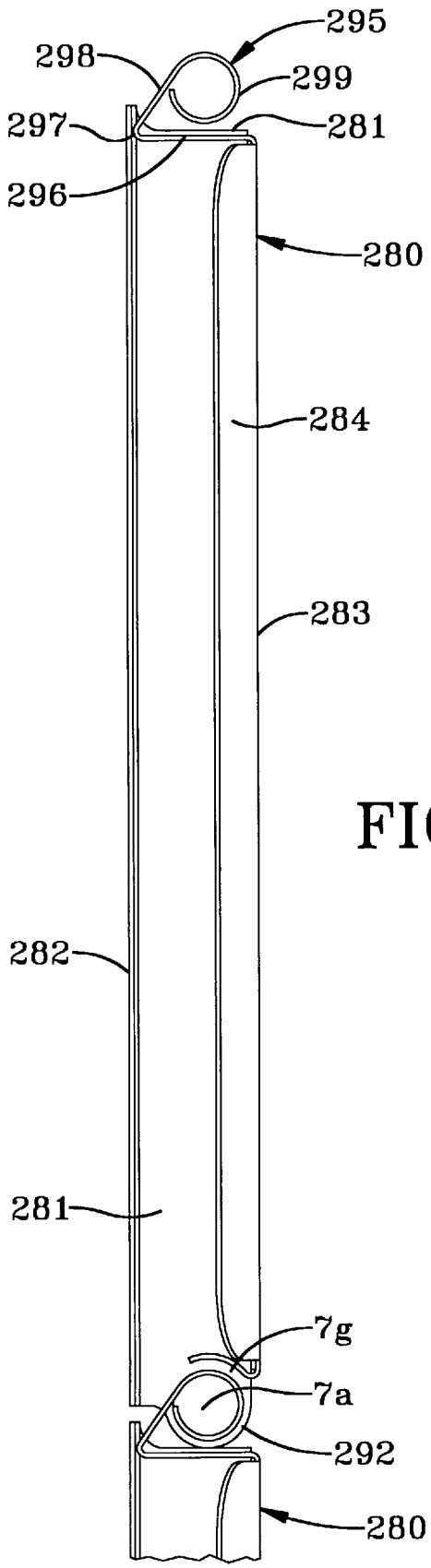
FIG. 17 is a side elevational view of the end stile of FIG. 16 showing structural details thereof.
Figure 18:
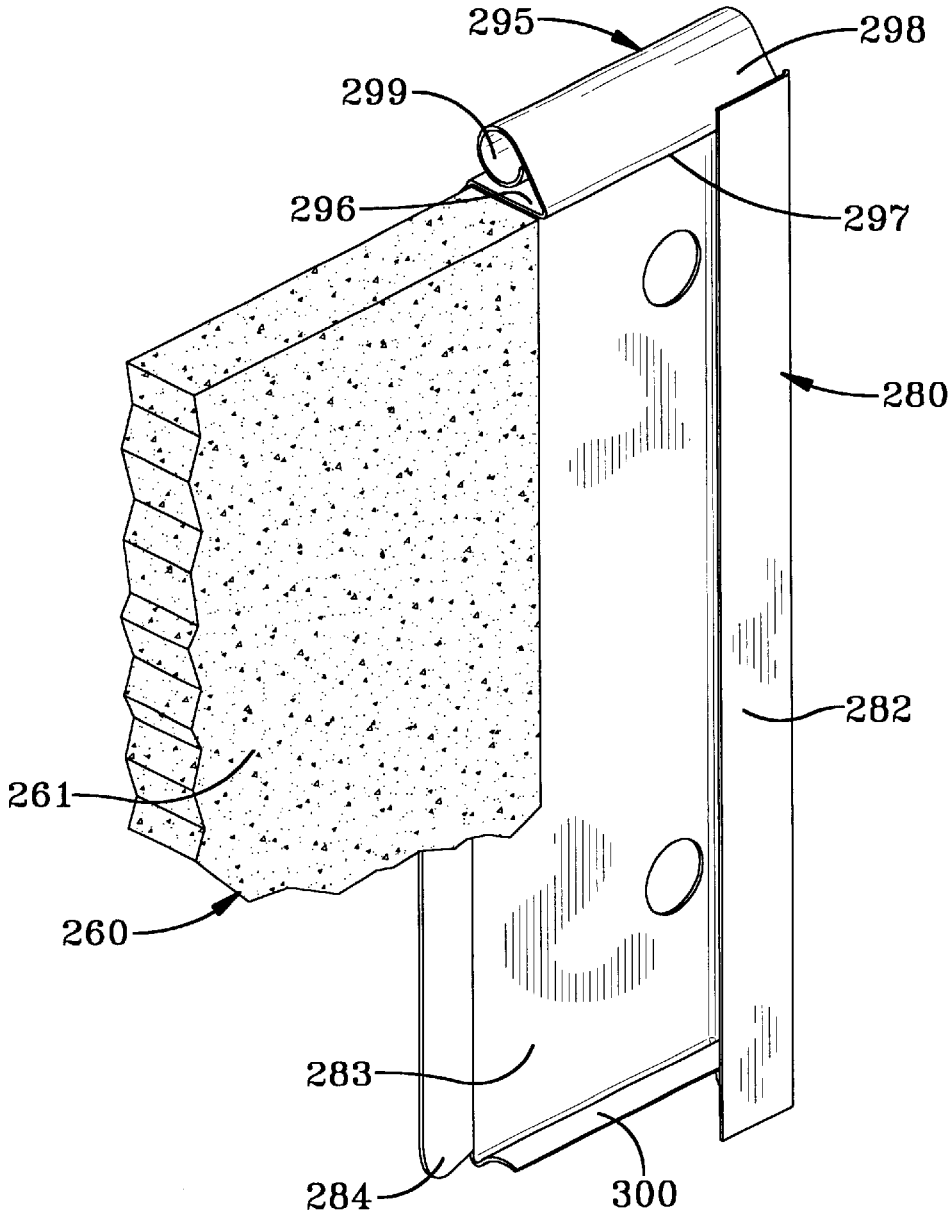
FIG. 18 is an enlarged front perspective view of the end stile of FIG. 16 showing additional structural details thereof together with the placement of insulating material in relation thereto.
Figure 23:
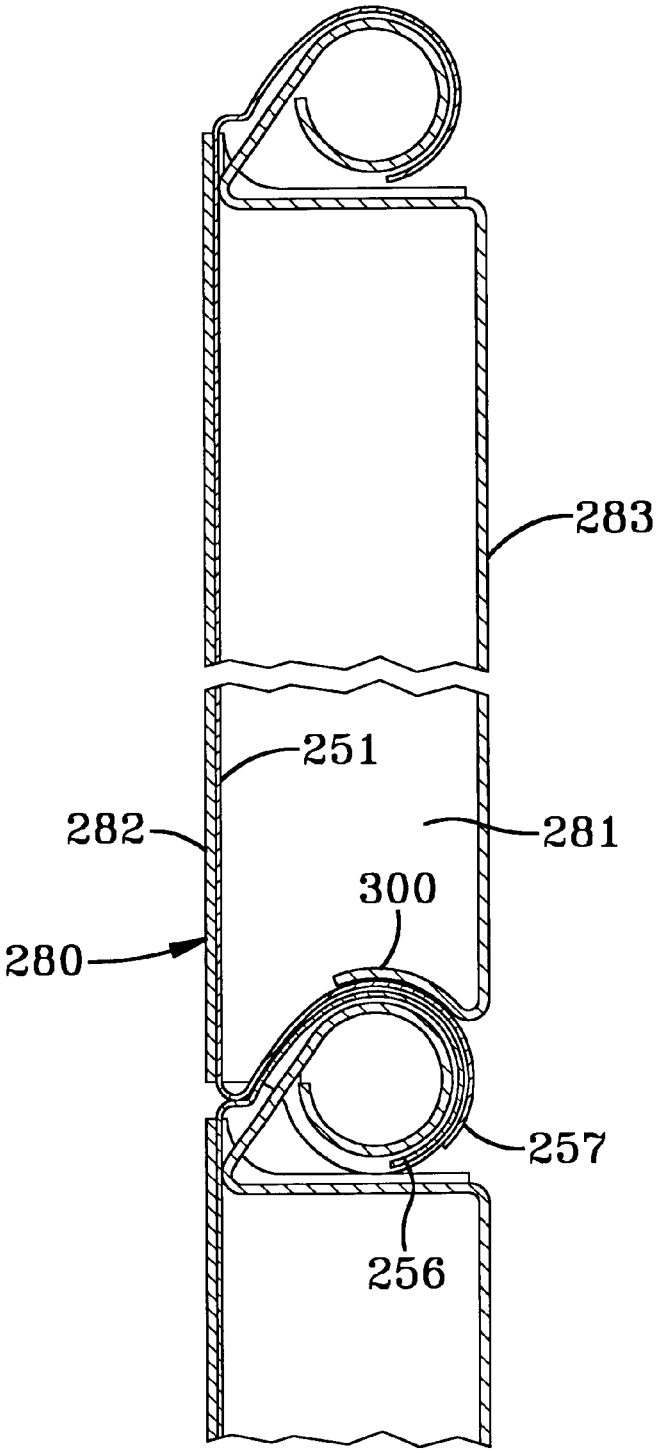
FIG. 23 is an enlarged fragmentary sectional view of the door taken substantially along the line 23—23 of FIG. 11 showing the relation between the end stiles and the cladding or facer material in the hinge areas.

The ends of the facers 250 of panels 240 are encased within end stiles, generally indicated by the numeral 280. As seen in FIGS. 15–19 and 23 the end stiles 280 are generally U-shaped members devised to receive the front surface 251 and the pivotal closure assemblies 255 of the facers 250 of panels 240. The end stiles 280 are defined by a planar end 281 which spaces and joins a front flange 282 and a rear flange 283. While the front flange 282 may be of a substantially lesser lateral extent than the rear flange 283, as best seen in FIG. 18, the front flange 282 does laterally overlie front surface 251 of facer 250 to an extent (FIG. 23). The rear flange 283 may extend inwardly of panel 240 to a greater extent than front flange 282 for strengthening purposes and other functions which will become apparent. The laterally inner extent of rear flange 283 displaced from the planar end 281 has an in-turned flap 284 which serves as a strengthening member and, in the case of insulated panels 240, overlies the lateral extremities of insulation layer 60 as best seen in FIG. 18. Thus, as previously indicated, the in-turned flap 284 in overlying the lateral extremities of insulation layer 260 completes the retention and shielding of all four edges of the insulation layer 260 from exposure inwardly of the panels 240. While the in-turned flap 284 is shown inclined inwardly from rear flange 283 through an angle of approximately 10 to 15 degrees, it is to be appreciated that this configuration of flap 284 may also be employed with an uninsulated version of panels 240. Alternatively, the in-turned flap 284 might be directed inwardly through an angle of approximately 90 degrees to repose in proximity to facer 250 to effect further strengthening of panels 240 at the location of end stiles 280.

The pivotal interconnection between adjacent panels 240 is effected primarily by hinge assemblies, generally indicated by the numeral 290. The hinge assemblies 290 are located at the end stiles 280 from which the main structural members are formed. At the bottom of each of the end stiles 280 is a lower hinge pin receiver, generally indicated by the numeral 291. The lower hinge pin receiver 291 is formed as a planar extension 292 of the end 281 of end stile 280. As best seen in FIG. 16, the planar extension 292, which preferably extends a distance below the rear flange 283 of end stile 280 and has a hinge pin receiving bore 293 in alignment with end 281 of end stiles 280. The hinge assemblies 290 have at the upper extremity of the end stiles 280 an upper hinge pin receiver, generally indicated by the numeral 295, which is cooperatively positioned in relation to the lower hinge pin receiver 291 when the door 224 is assembled. The upper hinge pin receiver 295 is shown formed as a continuation of the rear flange 283 of end stile 280 and includes a projecting leg 296 extending toward the front flange 282 of end stile 280. As shown the projecting leg 296 lies inside the planar end 281, is substantially perpendicular to both the front and rear flanges 282, 283 and extends from rear flange 283 into contact with front flange 282. The extremity of projecting leg 296 adjacent to front flange 282 has a reverse bend 297 which merges into a standoff leg 298 that is disposed at an acute angle to projecting leg 297 and directed outwardly of projecting leg 296 and back toward rear flange 283 of end stile 280. The standoff leg 298 transcends into a substantially cylindrical hinge pin receiving sleeve 299 which is offset from the projecting leg 296 and preferably located substantially medially between front flange 282 and rear flange 283 of end stile 280.

Figure 15:
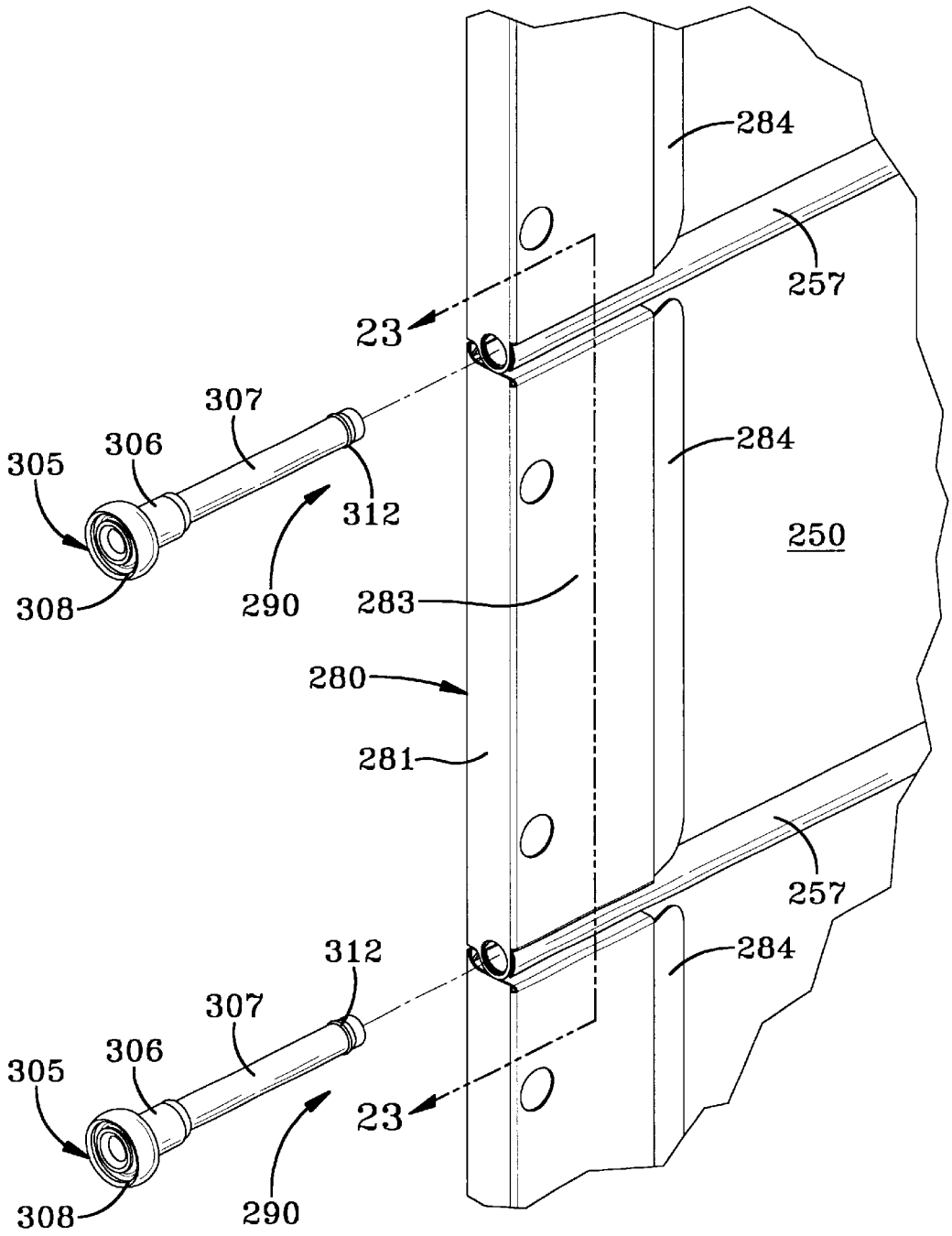
FIG. 15 is an exploded fragmentary perspective view of a plurality of adjacent panels showing the roller assemblies mounted between the panels on the end stiles.
Figure 19:
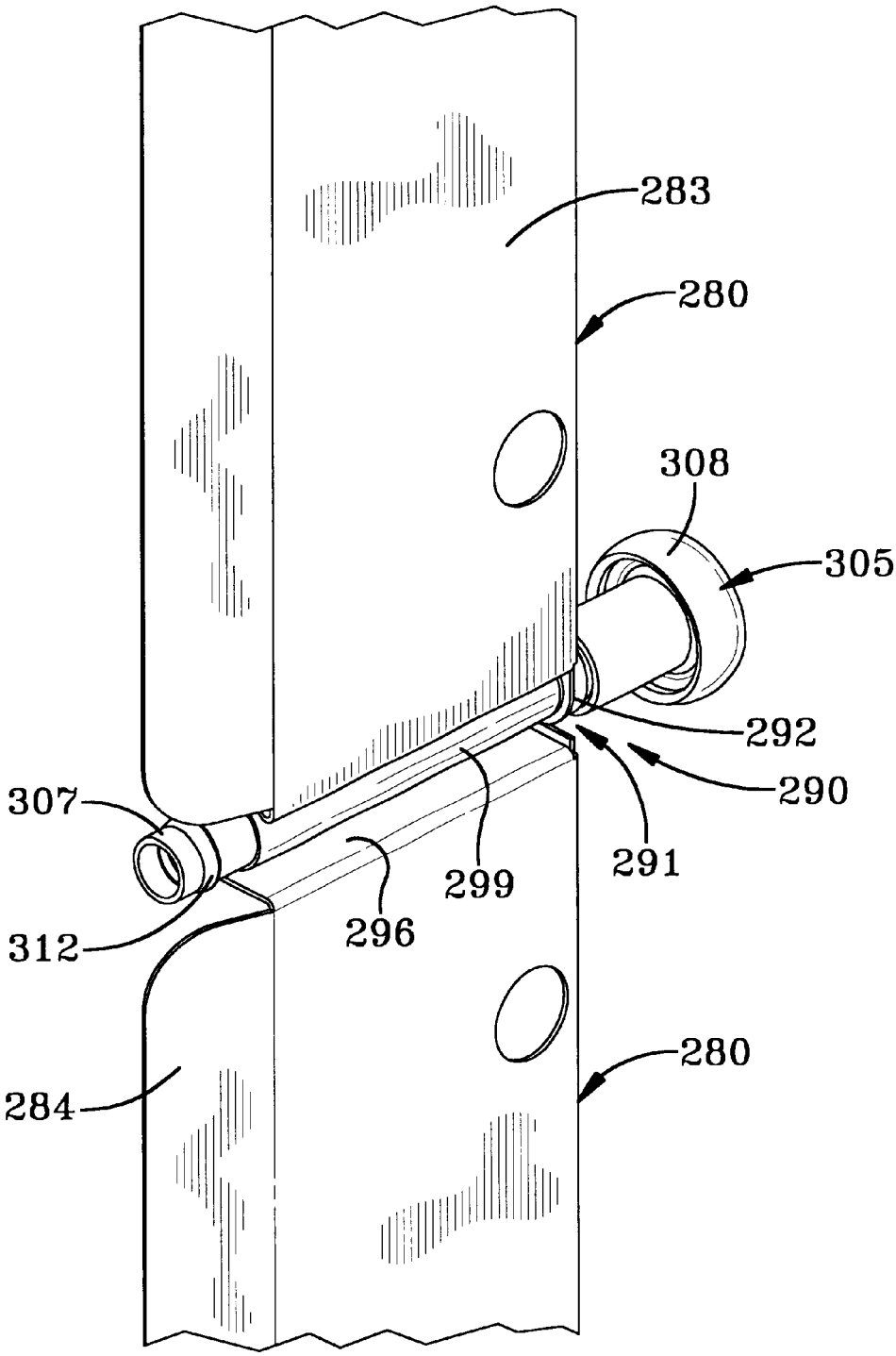
FIG. 19 is an enlarged fragmentary perspective view of a pair of adjacent panels showing details of the roller assemblies and the relation with the hinge elements of adjacent panels.
Figure 22:
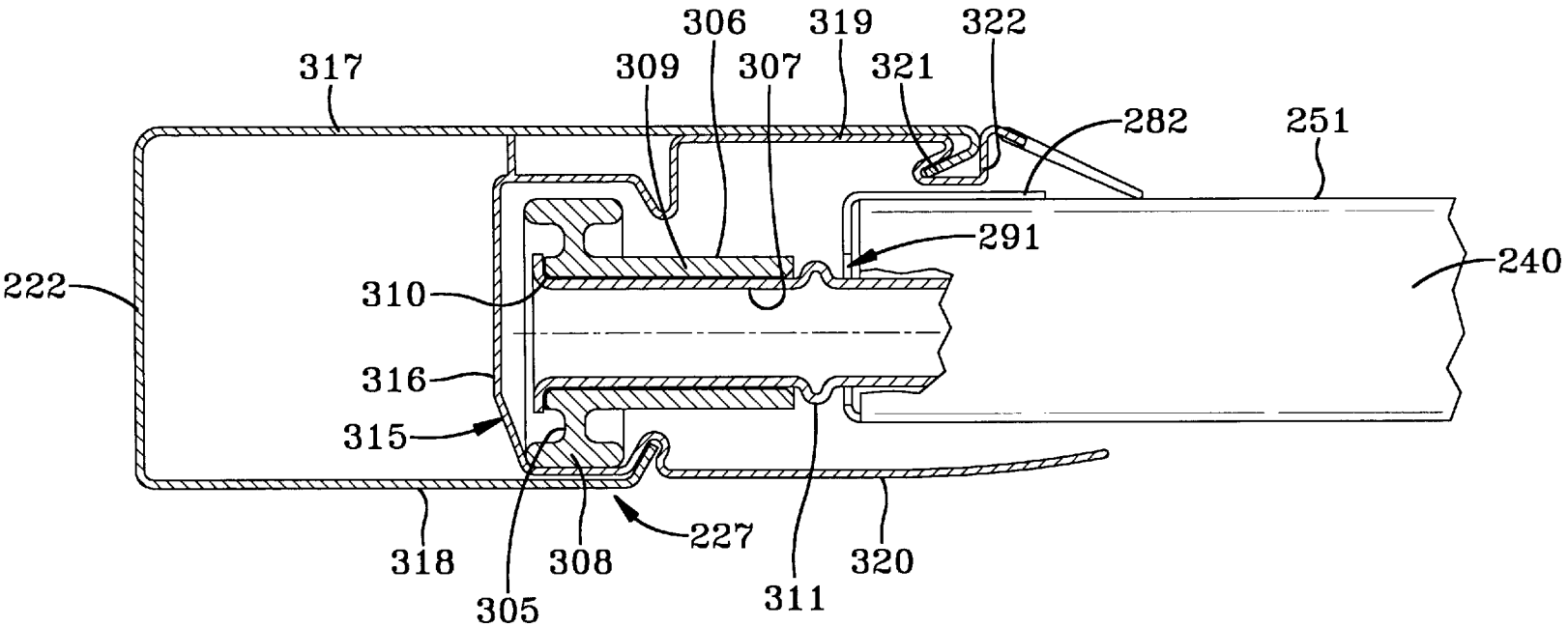
FIG. 22 is an enlarged fragmentary sectional view taken substantially along the line 22—22 of FIG. 11 through the vertical track, roller assembly and a portion of a door panel showing details thereof.

The lower edge of the panels 240 also has an arcuate flange 300 which is involved in hinge assemblies 290. The arcuate flange 300, as best seen in FIGS. 17, 18 and 23, is a continuations of the bottom of rear flange 283 of end stiles 280 which projects inwardly and upwardly from rear flange 283 from a distance approximately one-half the distance between front flange 282 and rear flange 283. As shown, the arcuate flange 300 may be substantially a portion of a circle centered about the center of hinge pin receiving bore 293 at a slightly lager radius, such as to substantially parallel the hinge pin receiving bore 293. The arcuate flange 300 preferably runs the entire lateral extent of the rear flange 283 of end stile The hinged connection of the lower hinge pin receiver 291 and upper hinge pin receiver 295 of hinge assemblies 290 is affected by roller assemblies, generally indicated by the numeral 305. As best seen in FIGS. 15, 19 and 22, the roller assemblies 305 may be similar to the roller assembly 95 discussed hereinabove. The roller assembly 305 includes a roller body 306 journaled to a roller shaft 307. The roller body 306 includes a roller wheel 308 that extends radially outwardly from a collar 309 and may be integrally formed with the collar 309 (FIG. 22). To restrict axial movement of the roller body 306 relative roller shaft 307, the roller shaft 307 may be provided with an annular flange 310 at its outermost extremity and a radially upstanding annular rib 311 based axially inwardly therefrom, such that the roller body 306 rests between the projecting surfaces of the flange 310 and the rib 311.

As can be seen in FIGS. 15, 19 and 22, the roller shaft 307 is inserted into the receiving bore 293 of the lower hinge pin receiver 291 and through the cylindrical hinge pin receiving sleeve 299, whereby the roller shaft 307 serves as a hinge pin for the hinge assemblies 290. The annular rib 311 also prevents over insertion of the roller shaft 307 within lower hinge pin receiver 291 by being sized larger than the hinge pin receiving bore 293. The roller shaft 307 has a second or inward annular rib 312 proximate the end of roller shaft 307 opposite the roller body 306. As shown the annular rib 311 and the second annular rib 312 are spaced a sufficient distance on roller shaft 307 such that the roller shaft 307 is axially moveable within the sleeve 299 to an extent necessary to accommodate variations in the roller tracks 27 or spacing between the tracks 27, 27 to either side of the door 24 at different locations.

The roller assemblies 305 are easily assembled in that the shaft may be readily inserted through pin receiving bore 293 which is larger in size than the second annular rib 312. Since the cylindrical sleeve 299 is not a continuous integral piece, it springs open to receive the second annular rib 312 and returns to its original configuration once the second annular rib 312 extends inwardly of sleeve 299 in the assembled position depicted in FIG. 19. Withdrawal of the roller shaft 307 is precluded by the second annular rib 312 engaging the laterally inner edge of cylindrical sleeve 299. It is to be appreciated that the second annular rib 312 could take the form of outwardly projected tabs or punchouts in the roller shaft 307 located at one or more spaced circumferential locations about the circumference of the roller shaft 307 to similarly permit insertion of shaft 307 in cylindrical sleeve 299 while retarding withdrawal therefrom which may provide a type of tensioning in the closed position of the door to resist wind loads in the manner described above.

Referring to FIGS. 11, 12 and 22, the vertical track sections 228 may be provided with a liner generally indicated by the numeral 315, which may be similar to the liner 110 discussed above. The liner 315 may similarly be made of a polymeric material to reduce noise generated by the roller assemblies 95 and to overlie the ends of the panels 224. Thus, the liner 315 serves to prevent entry of fingers and foreign objects at the sides of the door 24 while providing a weather seal, a door stop and assisting in stabilizing the door 224. As best seen in FIG. 22, the liner 315 includes an insert portion which is sized to fit within the roller track 27 and has a substantially C-shaped cross-section for receiving the roller wheels 308 while fitting within the roller track 227. The roller track 227 has an outer track flange 317 and an inner track flange 318. The liner 315 has a front cover portion 319 and a rear cover portion 320 which extend from the insert portion 316 toward door 224 and are spaced a distance therefrom such as not to intrude upon the operation of the door 224. As previously indicated, coverage of this area prevents foreign objects from intruding upon the function of the door 224 and constitutes a pinch guard for persons working on or in proximity to the door 224 when it is opening or closing. The liner 315 differs from the liner 110 in that the outer track flange extends to overlie the front flange 282 of end stile 280 to form a door stop 321. As seen in FIG. 22, the front cover portion 319 extends around stop 321 to form a planar stop surface 322 which is adapted to engage door panel 240 and particularly the front flange 282 of end stile 280 when the door is in the closed position.

The liner 15 preferably includes front and rear flanges 323 and 324, respectively, which extend laterally inwardly from the front cover portion 319 and the rear cover portion 320, respectively, to overlie the panels 240. The flanges 323 and 324 taper inwardly toward the door with the front flange 323 preferably contacting the facer surface 251 of panels 240. The front flange 323 serves primarily as a weather seal, while the rear flange 324 constitutes a finger shield between planar end 281 of end stile 280 and the roller tracks 227. As in the case of liner 110 the liner 315 generally extends the length of vertical track sections 228 of roller track 227. The rear flange 324 terminates short of the top of vertical track section 28 near transition section 330 as seen in FIG. 12 to permit movement of the door into the transition track section 230. If desired, the transition track sections 230 and horizontal track sections 229 may have the insert portion 316 of liner 315 for purposes of abating noise.

As in the case of door system 20, the door system 220 may employ a pivoting operator, generally indicated by the numeral 325 in FIG. 11 of the drawings. As indicated in conjunction with the door system 20, the pivotal operator 325 has the capability of effecting final closing and locking of door 224.

In the instance of use of a pivotal operator 325, the uppermost section 241 of the door 224 may be provided with a pivoting roller, generally indicated by the numeral 330, instead of a conventional fixed roller. As seen in FIG. 12, the pivoting roller 330 has a support arm 331 which may be a generally U-shaped member having an attachment leg 332 and a roller mounting leg 333. The attachment leg is adapted to seat against the rear flange 283 of end stile 280 or a reinforcing plate 334 positioned thereon. Attachment leg 332 is secured in place on panel 241 by one or more sheet metal screws 335 or other appropriate fasteners. The roller mounting leg 333 carries a cylindrical sleeve 336 which may be integrally formed with roller mounting leg 333 and be configured similar to the cylindrical hinge pin receiving sleeve 299 of the upper hinge pin receiver 295. In this manner the sleeve 336 may receive a roller assembly 337 which is configured and positioned in the same manner as roller assemblies 305 of the hinge assemblies 290. The pivoting roller 330 preferably has the support arm 331 constructed of a relatively thin metal or plastic material to permit flexing in the bend area 338 which joins attachment leg 332 and the roller mounting leg 333. Since the requisite flexing in bend area 338 may be achieved by employing a relatively thin material for support arm 331, the roller mounting leg 333 may be provided with a strengthening embossment 339.

The pivoting roller 330 is shown in its stressed condition in FIG. 12 with the door 224 in the fully closed position. In such instance, the roller assembly 337 and roller mounting leg 333 have been angularly displaced outwardly from the normal position by the pivoting operator 325 engaging and forcing the top panel 241 to the closed position. Once opening of the door commences, the support arm 331 returns to its initial configuration with the cylindrical sleeve 336 in engagement with the stile 280 and thus substantially aligned with top panel 241 as depicted at the chain line position 330' in FIG. 12. With the cylindrical sleeve 336 and roller assembly 337 thus in close proximity to the top panel 241 during movement of pivoting roller 330 in the horizontal track section 229, the top of the door section 241 remains essentially aligned with the horizontal track section 229 so as to permit installation of the door system 220 in a low overhead environment.

Figure 20:
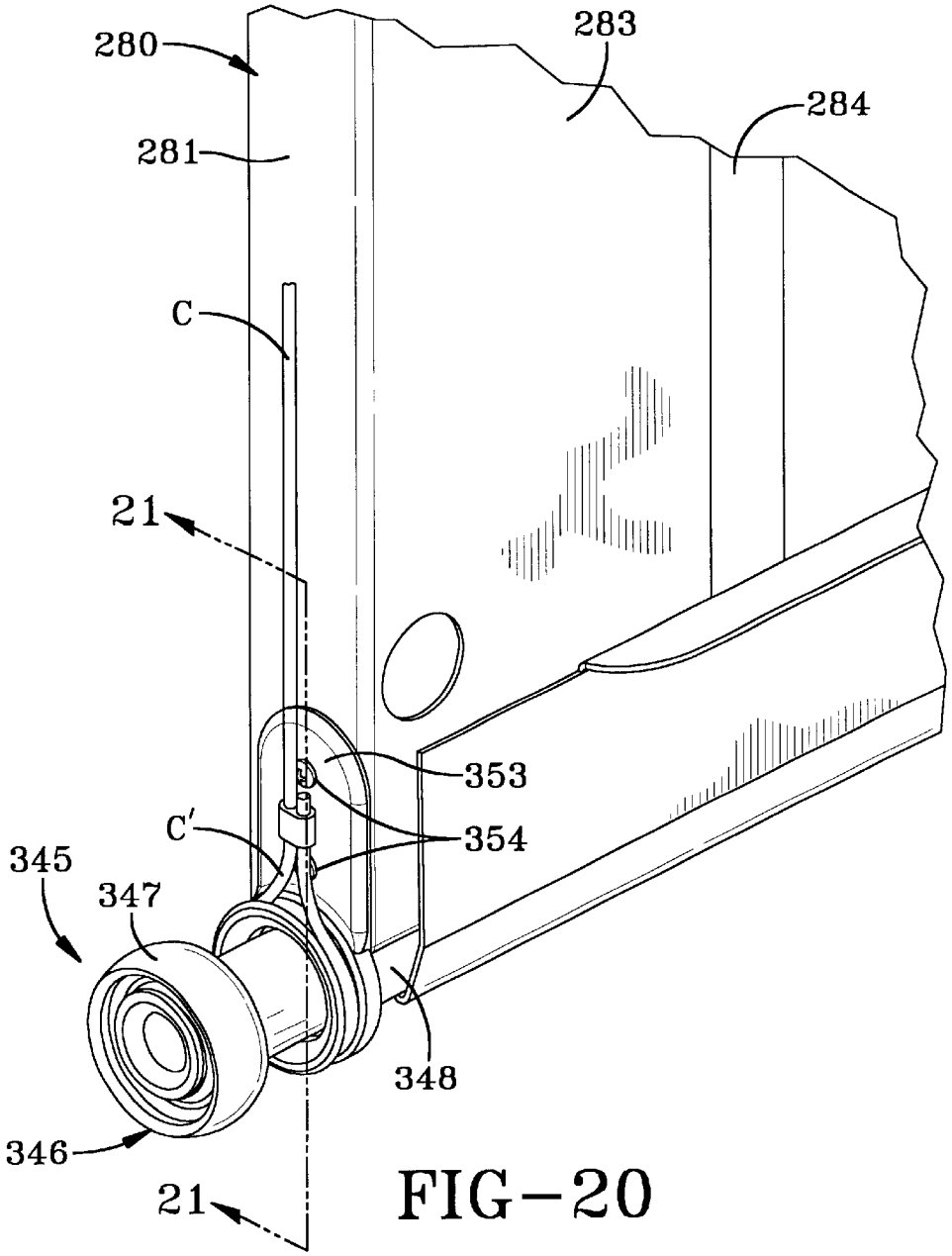
FIG. 20 is an enlarged fragmentary perspective view of a bottom and rear corner of the door of FIG. 11 showing the combined track engaging roller assembly and associated cable bracket for securing a counterbalance cable.
Figure 21:
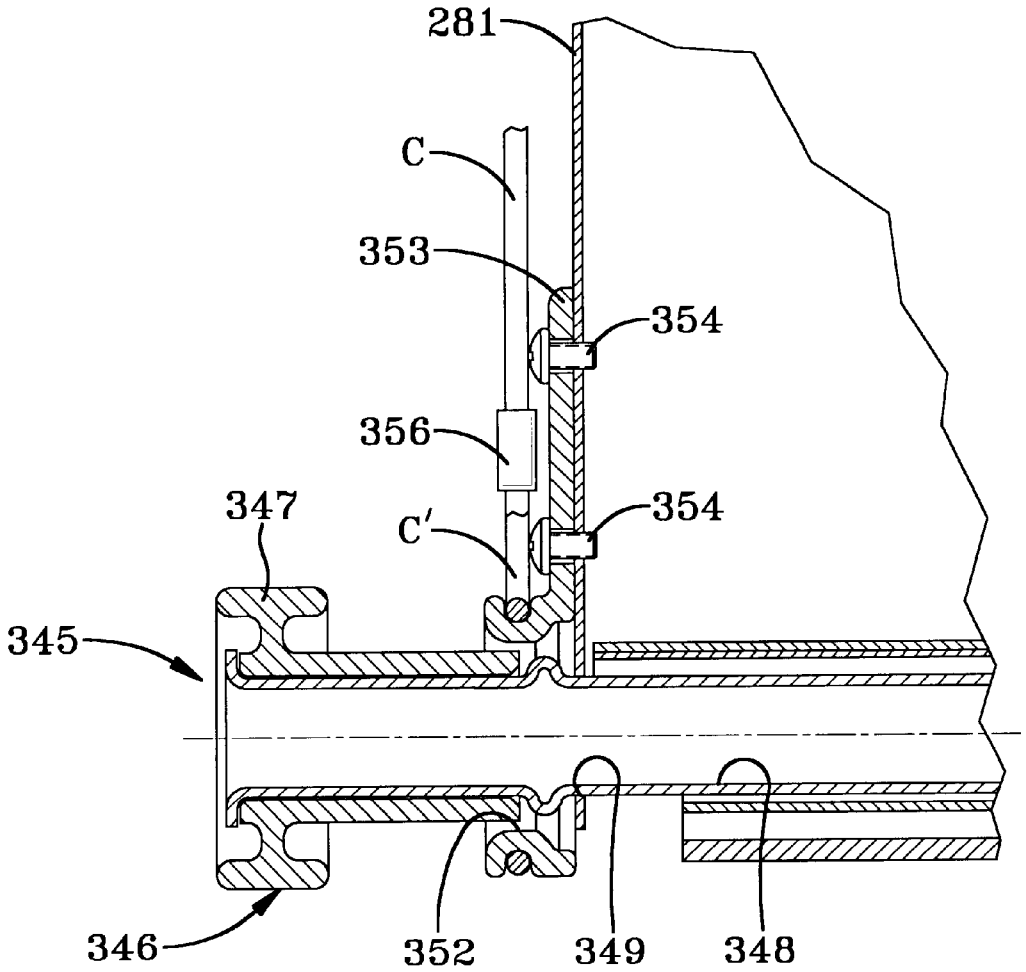
FIG. 21 is a sectional view of the bottom panel roller and cable bracket taken substantially along the line 21—21 of FIG. 20.

The lower corners of the door 224 may be provided with a combined roller assembly and cable-securing device, generally indicated by the numeral 345. Referring particularly to FIGS. 20 and 21, the combined roller assembly and cable-securing device 345 includes a roller assembly, generally indicated by the numeral 346, which may have the same structure as the roller assemblies 305. In particular, the roller assembly 305 includes a roller body 347, a roller shaft 348 and the structural details thereof as described above. The roller shaft 348 is inserted in an aperture 349 in the planar end 281 of end stile 280. The combined roller assembly and cable-securing device 345 also includes a cable bracket, generally indicated by the numeral 350, which is interposed between the roller body 347 and the end 281 of end stile 280.

The cable bracket 350 has a generally cylindrical collar 351 which receives the roller shaft 348 but is preferably of a sufficiently larger internal diameter 352 such as to remain spaced therefrom during operation of door 224. The cable bracket 350 has an elongated projection 353 extending radially from the collar 351 which is attached to the end 281 of end stile 280 as by screws 354 or other appropriate fasteners. The collar 351 also has a groove 355 which is adapted to receive a standard cable C which has one end reeved about the collar 351 to form a loop C' and secured by a cable clamp 356 and the other end operatively interrelated with the counterbalance system 225. Thus, the loop C' of cable C may attach to door 224 at an optimum position while permitting angular movement of the cable relative to groove 355 of cable bracket 350 as its position varies relative to the counterbalance system 225. It will also be appreciated that the tension in cable C produced by counterbalance system 225 is transmitted to door 224 without imparting forces to the roller shaft 348 or roller body 347 of roller assembly 346.

Thus, it should be evident that the upward acting sectional door disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. An upward acting sectional door comprising, a plurality of door panels pivotally attached to each other, each panel having a front surface and a rear surface spaced from each other by an internal structure, the internal structure defining a plurality of encapsulated spaces between the front and rear surfaces which provide a thermal break therebetween, wherein said panels are pivotally attached to each other by a flexible hinge member at an edge of said panels, said flexible hinge member including a double loop having an inner leg and an outer leg with said outer leg spaced from and substantially paralleling said inner leg and said flexible hinge member extending the entire lateral extent of said panels.

2. The door of claim 1, wherein said internal structure includes a plurality of dividers located within the front and rear surfaces.

3. The door of claim 2, wherein said dividers are configured in a honeycomb arrangement.

4. The door of claim 2, wherein the dividers are intersecting horizontal and vertical surfaces.

5. An upward acting sectional door comprising, a plurality of door panels pivotally attached to each other, each panel having a front surface and a rear surface spaced from each other by an internal structure, the internal structure defining a plurality of encapsulated spaces between the front and rear surfaces which provide a thermal break therebetween, and a recess formed in said rear surface of said panel and an end stile fitting over an end of said panel, said end stile including a tab releasably received within said recess.

6. The door of claim 5, wherein said end stile includes a front flange, a rear flange, and an end extending between said front and rear flanges to define a generally U-shaped member having an open end sized to receive said front surface and said rear surface.

7. The door of claim 6, wherein said rear flange does not extend the full height of said panel to permit relative rotation between adjacent of said plurality of door panels.

8. The door of claim 6, wherein said end of said end stile has a top rounded extremity and a bottom rounded recess, whereby said top rounded extremity of one of said plurality of door panels pivotally interfits within said bottom rounded recess in an adjacent one of said plurality of door panels.

9. The door of claim 6, wherein said end of said end stile has an opening adapted to receive a roller assembly.

10. The door of claim 9, wherein said roller assembly includes a shaft extending through said opening.

11. An upward acting sectional door comprising, a plurality of door panels pivotally attached to each other, each panel having a front surface and a rear surface spaced from each other by an internal structure, the internal structure defining a plurality of encapsulated spaces between the front and rear surfaces which provide a thermal break therebetween and a hinge pivotally connecting said plurality of door panels and a reinforcing member received within said hinge, said reinforcing member receiving a shaft of a roller assembly.

12. An upward acting sectional door comprising, a plurality of door panels pivotally attached to each other, each panel having a front surface and a rear surface spaced from each other by an internal structure, the internal structure defining a plurality of encapsulated spaces between the front and rear surfaces which provide a thermal break therebetween and a cladding covering the front surface of said panels, wherein said cladding is releasably attached to said panels by a pair of hooks, the first hook extending from the top of said cladding and the second hook extending from a bottom of the cladding and said panels have a flexible hinge interacting with said first hook and said second hook.

13. The door of claim 12, wherein said first hook and said second hook interengage and are maintained in operative pivotal relationship by said flexible hinge.

14. The door of claim 12, wherein said flexible hinge is formed integrally with one of said panels and retained in operative relation with an adjacent of said panels by said cladding.

15. A sectional door having a plurality of panels joined by a hinge, the hinge comprising, a flexible double loop member extending between adjacent panels, said flexible member defining a first axis and a second axis about which said sections pivot, wherein at least one of said axes is moveable relative to said panels during operation of the door such that stresses within the hinge caused by articulation of the panels are relieved by pivoting about said axes and movement of at least one of said first and second axes.

16. The hinge of claim 15, wherein said hinge extends the entire lateral width of the door.

17. A sectional door having a pair of opposed tracks for guiding door rollers between a closed position and an open position having a liner within the tracks comprising, an insert portion adapted to conform to the inner surface of the track for contacting the door rollers, a cover portion attached to the insert portion and bridging the space between the door and the tracks to prevent entry of foreign matter, and a sealing portion attached to the cover portion and extending to at least partially cover the door as a weather seal and to assist in stabilizing the door.

18. The door of claim 17, wherein said sealing portion includes a pair of opposed flanges spaced from each other and defining a gap adapted to receive an end of the door.

19. The door of claim 17, wherein at least one of said flanges contacts a surface of the door.

20. The door of claim 18, wherein one of said flanges has a stop for engaging, and positioning the door in the closed position.

21. A pre-packaged upwardly acting sectional door system comprising, a pair of spaced track framers spanned by a header, a pair of tracks associated with said track framers, a door having a plurality of panels pivotally joined by hinge members, roller assemblies on said door received in said tracks, a counterbalance system attached to said header and operatively engaging said door, and an operator mounted on said header operatively interconnected with said counterbalance system and positioned to maintain said door in a closed position relative to said header, said track framers, said tracks, said door, said rollers, said counterbalance system and said operator being operatively assembled for transport and installation.

22. A pre-packaged, assembled upwardly acting sectional door system comprising, a pair of spaced track framers spanned by a header, a pair of tracks associated with said track framers, a door having a plurality of panels pivotally joined by hinge members, roller assemblies on said door received in said tracks, a counterbalance system attached to said header and operatively engaging said door, and an operator mounted on said header operatively interconnected with said counterbalance system and positioned to maintain said door in a closed position relative to said header and a motor pivotable between an operating position and a locked position, said motor being in a locked position adjacent the door.

23. An upwardly acting sectional door system comprising, a plurality of sections including a top section, the sections being mounted between a pair of tracks, including horizontal track sections, which guide the door between a closed and an open position, a roller assembly, having an arm pivotally attached to said top section at one end thereof, a wheel rotatably attached to said arm at the other end thereof, wherein said wheel fits within said tracks causing said arm to pivot from a position at an angle to said top section when the door is in the closed position to a position above and substantially in planar alignment with said top panel when the door moves toward the open position, whereby said top section never projects above said horizontal track section to eliminate the need for overhead clearance.

24. The roller assembly of claim 23, wherein the arm is biased to said position substantially aligned with said top panel.

25. The roller assembly of claim 24, wherein said arm is biased by a spring interposed between said arm and said top section.

26. The roller assembly of claim 24, wherein said arm is made of a unitary flexible material.

27. A sectional door comprising, first and second adjacent panels, a flexible double loop member having an inner leg and an outer leg joined by a curve return extending between said adjacent panels and attached to said first and second adjacent panels, a first hook attached to one of said first and second adjacent panels and interposed between said inner leg and said outer leg, said return curve movable about an axis located substantially centrally of said flexible double loop member during a portion of the articulation of said first and second panels and said outer leg and said hook movable about said return curve during a portion of the articulation of said first and second panels.

28. A sectional door according to claim 27 further comprising, a second hook attached to the other of said first and second panels and overlying a portion of said inner leg of said flexible double loop member.

29. A sectional door according to claim 28, wherein said first hook and said second hook are in engagement during a portion of the articulation of said first and second panels.

30. A sectional door according to claim 29, wherein said first hook and said second hook develop a crescent-shaped gap therebetween during a portion of the articulation of said first and second panels.

* * * * *